US010926992B2

(12) United States Patent
Stolk

(10) Patent No.: US 10,926,992 B2
(45) Date of Patent: Feb. 23, 2021

(54) ADAPTER AND ADAPTER ASSEMBLY FOR CONNECTING A REMOVABLE LIQUID CONTAINER TO A LIQUID DISPENSER AND ALSO A METHOD OF INSTALLING AND USING AN ADAPTER ASSEMBLY

(71) Applicant: 'R PRODUCTS AB, Gothenburg (SE)

(72) Inventor: Christopher Stolk, Molndal (SE)

(73) Assignee: 'R PRODUCTS AB, Gothenburg (SE)

( * ) Notice: Subject to any disclaimer, the term of this patent is extended or adjusted under 35 U.S.C. 154(b) by 30 days.

(21) Appl. No.: 16/489,444

(22) PCT Filed: Feb. 28, 2018

(86) PCT No.: PCT/SE2018/050195
§ 371 (c)(1),
(2) Date: Aug. 28, 2019

(87) PCT Pub. No.: WO2018/160126
PCT Pub. Date: Sep. 7, 2018

(65) Prior Publication Data

US 2020/0031657 A1 Jan. 30, 2020

(30) Foreign Application Priority Data

Feb. 28, 2017 (SE) ..... 1730050-0

(51) Int. Cl.
*B67D 3/00* (2006.01)

(52) U.S. Cl.
CPC ..... *B67D 3/0032* (2013.01)

(58) Field of Classification Search
CPC ..... B67D 3/00; B67D 3/0025; B67D 3/0029; B67D 3/0032
(Continued)

(56) References Cited

U.S. PATENT DOCUMENTS 3,843,021 A * 10/1974 Schieser ..... B67D 3/00 222/105
5,273,083 A * 12/1993 Burrows ..... B67D 1/0835 141/18
(Continued)

FOREIGN PATENT DOCUMENTS

SE 516584 C2 11/2000
WO 0071462 A1 11/2000
(Continued)

OTHER PUBLICATIONS

ISR; Patent-OCH Registeringsverket; Stockholm; Jun. 20, 2018.

*Primary Examiner* — Timothy L Maust
(74) *Attorney, Agent, or Firm* — Patshegen IP LLC; Moshe Pinchas

(57) ABSTRACT

An adapter (9) for connecting a removable liquid container (10) to a liquid dispenser (1), said adapter having at a first end thereof a liquid container connector and at a second end thereof a dispenser connector, said liquid container connector having a probe part (12) adapted to pierce an outlet comprising a self-sealing valve or membrane of said removable liquid container (10), said probe part (12) being hollow and having at least one inlet for liquid from said removable liquid container, said dispenser connector being hollow and having at its end remote from said probe part an outlet for liquid from said removable liquid container, wherein the outlet of the dispenser connector is adapted to fit tightly around an existing feed tube of the liquid dispenser (1). The adapter (9) can be part of an adapter assembly, which can optionally comprise a liquid transfer regulating means (11) adapted to cooperate with and regulate liquid transfer through said adapter (9).

18 Claims, 23 Drawing Sheets

(58) Field of Classification Search
USPC ..... 141/363–366
See application file for complete search history.

(56) References Cited

U.S. PATENT DOCUMENTS

| | | | | |
|---|---|---|---|---|
| 5,431,205 | A * | 7/1995 | Gebhard | B67D 1/0835 141/286 |
| 6,167,921 | B1 * | 1/2001 | Busick | B67D 3/0032 141/18 |
| 2015/0298957 | A1 | 10/2015 | Orita | |
| 2016/0207751 | A1 * | 7/2016 | Groesbeck | B67D 3/0067 |

FOREIGN PATENT DOCUMENTS

| | | | |
|---|---|---|---|
| WO | 2008028240 | A1 | 3/2008 |
| WO | 2013022300 | A2 | 2/2013 |

* cited by examiner

ADAPTER AND ADAPTER ASSEMBLY FOR CONNECTING A REMOVABLE LIQUID CONTAINER TO A LIQUID DISPENSER AND ALSO A METHOD OF INSTALLING AND USING AN ADAPTER ASSEMBLY

FIELD OF THE INVENTION

The present invention relates to an adapter for connecting a removable liquid container to a liquid dispenser. The invention also relates to an adapter assembly comprising such an adapter and further relates to a method of installing and using such an adapter assembly.

BACKGROUND OF THE INVENTION

Worldwide many offices, private and public institutions, hotels, etc. use combined coolers and dispensers for drinking water and for other types of drinks. One kind of such combined coolers and dispensers comprises a unit where a substantially rigid water bottle made of plastic and having a narrow neck forming the bottle opening is placed bottom up on the top of the water dispenser. The bottle-shaped container has a standardized shape and most often a volume of 5 or 3 gallons.

Currently most water bottles are closed and sealed with a valved bottle cap which automatically opens when the bottle is placed bottom-up on the top of the dispenser. These types of capped bottles require a water dispenser which has a water inlet probe (feed tube) located in the centre of the downwardly extended opening of the water dispenser. The feed tube has a standardized shape and most water dispensers have this feature nowadays. When the bottle is placed bottom-up on the top of feed tube of the water dispenser the valve in the cap of the bottle is in open position, the inner volume of the container will communicate with a reservoir in the dispenser and with the dispensing unit where water can be tapped into drinking cups or the like.

When using the above mentioned bottles, water tapped from the bottle has to be substituted by air. Air is supplied to the bottle as water is being tapped from the dispenser. It has, however, been found that by using this kind of container, the air supplied to the container may contain bacteria and as the container which its content is normally kept at room temperature, the bacteria which enter the container may multiply in number and may give rise to infections when drinking the water. Exposure to UV light can also influence the quality of the water, storage of water in transparent containers in a warm environment may also increase the number of bacteria in the container.

The water bottles are relatively expensive and are generally reusable. Full water bottles are delivered to the site of the water dispenser and empty water bottles are picked up, refilled, and reused. In order to reuse the bottles they need to be sorted, disinfected, cleaned and tested for leakage before they can be refilled with clean water. A lot of energy and (clean) water needs to be used during this process. Further, the use of bottle-shaped containers is not very efficient for transport and storage, also special equipment is required to store and ship such containers. Rectangular shaped containers would on the other hand occupy far less space and require no special equipment for storage or transport. Using a collapsible liquid container such as a bag-in-box container would save a lot of transport and storage space, especially when transporting and storing empty packaging one can save around 80% of space.

One problem when replacing rigid liquid containers with collapsible non-rigid liquid containers is that non-rigid containers will immediately empty themselves (due to gravity dispensing) of their contents once inverted upon a traditional liquid dispenser and in fluid communication with the reservoir therein. Some liquid dispensers provide a mechanism to solve this problem as the same occurs when bottles have small cracks in them and will empty themselves.

Furthermore, connecting a non-rigid liquid container such as a bag-in-box liquid container to the liquid dispenser should not require more, additional actions compared to connecting a regular liquid bottle.

SUMMARY OF THE INVENTION

Accordingly, a first object of the present invention is to provide an adapter which reduces the risk of air- and light-induced bacterial contamination and proliferation in water or other liquid in liquid dispensers and which also reduces the high costs and high environmental impact associated with the use of rigid liquid bottles as liquid containers in liquid dispensers.

This first object is achieved by means of an adapter for connecting a removable liquid container to a liquid dispenser, according to claim 1, having at a first end thereof a liquid container connector and at a second end thereof a dispenser connector, said liquid container connector having a probe part adapted to pierce an outlet comprising a self-sealing valve or membrane of said removable liquid container, said probe part being hollow and having at least one inlet for liquid from said removable liquid container, said dispenser connector being hollow and having at its end remote from said probe part an outlet for liquid from said removable liquid container, wherein said outlet of said dispenser connector is adapted to fit tightly around an existing feed tube of said liquid dispenser. By providing such an adapter, the rigid and space-consuming bottles commonly used as containers for water and other liquids in existing liquid dispensers can be replaced with less costly and more environmentally friendly collapsible liquid containers such as bag-in-box liquid containers. Furthermore the risk of bacterial contamination and proliferation in water or other liquid induced by air and/or light is reduced.

A second object of the present invention is to provide an adapter with appropriate dimensions to ensure that it functions properly and safely when mounted on an existing dispenser for water or other liquid.

This second object is achieved by means of an adapter according to claim 2, which, when in use, is adapted to transfer liquid from said at least one inlet of said probe part to one or several inlets of said feed tube of said liquid dispenser and that said adapter is dimensioned so that, when in use, said at least one inlet of said probe part is positioned higher than said self-sealing valve or membrane of said outlet of said removable liquid container in a vertical direction and so that said outlet of said dispenser connector is positioned lower than said one or several inlets of said feed tube of said liquid dispenser in a vertical direction.

A third object of the present invention is to provide an adapter which reduces the risk of air-borne bacterial contamination when replacing a removable liquid container in the liquid dispenser with a new one.

This third object is achieved by means of an adapter according to claim 3, in which said probe part has a circular shape with a closed top and that said at least one inlet of said probe part is placed below said closed top. Such a design of the probe part reduces the risk of air-borne bacteria entering the adapter while replacing a removable liquid container with a new one.

A fourth object of the present invention is to provide an adapter which minimizes the modifications necessary to be able to mount the adapter on an existing liquid dispenser.

This fourth object is achieved by means of an adapter according to claim 4, in which said outlet of said dispenser connector is adapted to fit within an existing recessed area around said feed tube of said liquid dispenser.

A fifth object of the present invention is to provide an adapter which fits to many of the liquid dispensers on the market.

This fifth object is achieved by means of an adapter according to claim 5, in which said outlet of said dispenser connector is adapted to fit within a recessed area formed by an existing liquid dispenser support of said liquid dispenser, which is designed for receiving and supporting a liquid bottle in an inverted position.

A sixth object of the present invention is to provide an adapter which ensures a tight connection between itself and an existing feed tube of a liquid dispenser and which can be manufactured in a particularly advantageous manner.

This sixth object is achieved by means of an adapter according to claim 6, in which an area around said outlet of said dispenser connector is made of an elastomeric material, or a material with similar characteristics, adapted to create an air- and liquid-tight connection between said adapter and said feed tube of said liquid dispenser. By providing such an elastomeric material, or a material with similar characteristics, around the outlet of the dispenser connector, an air- and liquid-tight connection can be ensured and the dispenser connector can be manufactured in an advantageous manner by co-moulding two different polymers.

A seventh object of the present invention is to provide an adapter having a design which ensures a problem-free replacement of an empty liquid container.

This seventh object is achieved by means of an adapter according to claim 7, in which said elastomeric material, or material with similar characteristics, is adapted to provide a friction between itself and said feed tube that is higher than between said probe part and said self-sealing valve or membrane of said outlet of said removable liquid container. By selecting an elastomeric material or a material with similar characteristics with a suitable friction, it is ensured that the adapter stays connected to the feed tube of the liquid dispenser when replacing an empty liquid container.

An eight object of the present invention is to provide an adapter with a feed tube seal which can be manufactured in a flexible and cost-effective manner.

This eight object is achieved by means of an adapter according to claim 8, in which said elastomeric material, or material with similar characteristics, is provided in the form of an expandable circular feed tube seal having a slightly smaller inner diameter than an outer diameter of said feed tube of said liquid dispenser. Such a circular feed tube seal can easily be designed so as to fit different types of feed tubes and can be manufactured at a low cost.

A ninth object of the present invention is to provide an adapter with a feed tube seal having a shape which ensures a leak-free transport of liquid from the removable liquid container through the adapter into the feed tube.

This ninth object is achieved by means of an adapter according to claim 9, in which said feed tube seal has a profiled inner surface allowing said feed tube seal to expand around said feed tube and create an air and liquid-tight connection between said feed tube seal and said feed tube. Such a feed tube seal ensures an air and liquid-tight connection between the adapter and the feed tube.

A tenth object of the present invention is to provide an adapter with a feed tube seal which fits to the feed tubes of many of the existing liquid dispensers on the market.

This tenth object is achieved by means of an adapter according to claim 10, in which said inner diameter of said feed tube seal is between 15.0 and 18.0 mm in a non-expanded state.

An eleventh object of the present invention is to provide an adapter which is flexible in its design and easy to manufacture and transport.

This eleventh object is achieved by means of an adapter according to claim 11, in which said liquid container connector is connected to said dispenser connector with at least one packing ring. By designing the liquid container connector and the dispenser connector as two separate connectable components sealed by a packing ring, the adapter will be easier to manufacture and adapt to a specific type of removable liquid container or liquid dispenser and, in addition, the components of the adapter can be packed into a smaller package for delivery to a user who can easily assemble the components and install the adapter in a liquid dispenser. A smaller package is advantageous in that it is less expensive and space-consuming to transport and store, e.g. in containers, trailers, trucks, trains, ships, planes, in warehouses, on pallets, etc.

A twelfth object of the present invention is to provide an adapter which has a simple design and facilitates a rigid and firm connection between a removable liquid container and a liquid dispenser.

This twelfth object is achieved by means of an adapter according to claim 12, in which said liquid container connector and said dispenser connector form a unitary, substantially rigid hollow body.

A thirteenth object of the present invention is to provide an adapter with a liquid container connector designed as a box connector which ensures that a removable liquid container in the form of a bag-in-box container remains in its intended position.

This thirteenth object is achieved by means of an adapter according to claim 13, in which said liquid container connector is designed as a box connector provided with support surfaces adapted to support and/or hold a removable bag-in-box liquid container in a fixed position on top of said adapter and with a recessed area around said probe part for receiving an outlet with a self-sealing valve or membrane of said removable bag-in-box container whilst the bottom surface of said removable bag-in-box container rests on said support surfaces of said box connector.

A fourteenth object of the present invention is to provide an adapter with a box connector with a design which facilitates the handling of bag-in-box liquid containers for a user.

This fourteenth object is achieved by means of an adapter according to claim 14, in which side surfaces of said box connector are lower at their centre than at their corners to provide easier user access to cut-outs for handles of said removable bag-in-box liquid container.

A fifteenth object of the present invention is to provide an adapter with a design which improves the functional reliability of the liquid dispenser.

This fifteenth object is achieved by means of an adapter according to claim 15, in which the adapter comprises a duckbill valve or other non-return valve preventing return of liquid into said removable liquid container.

A sixteenth object of the present invention is to provide an adapter which can be mounted on a liquid dispenser having no means for controlling the liquid level in a liquid reservoir of the dispenser.

This sixteenth object is achieved by means of an adapter according to claim 16, wherein said adapter, when in use, is adapted to cooperate with a liquid transfer regulating means, which is mounted in a top opening of a liquid reservoir of said liquid dispenser and connected to an outlet of said feed tube via a feed tube connector so as to regulate liquid transfer through said adapter, wherein said feed tube is integrated into an existing liquid dispenser support of said liquid dispenser.

A seventeenth object of the present invention is to provide an adapter adapted for cooperation with a particularly advantageous liquid transfer regulating means.

This seventeenth object is achieved by means of an adapter according to claim 17, wherein said liquid transfer regulating means cooperating with said adapter comprises a valve shaft attached to a float connector and a float connected to said float connector, wherein said float has a buoyancy adapted to press a valve surface of said valve shaft against a valve surface of said feed tube connector so as to close an open valve area and stop liquid transfer through said adapter and feed tube into said liquid reservoir when a liquid level in said liquid reservoir is high and wherein gravity acting on said liquid transfer regulating means will keep said valve area open so that liquid can flow through said adapter and out of said feed tube into said liquid reservoir when said liquid level is low.

An eighteenth object of the present invention is to provide an adapter adapted for cooperation with a liquid transfer regulating means with a float which can be adjusted in height to fit different liquid dispensers.

This eighteenth object is achieved by means of an adapter according to claim 18, wherein said valve shaft and/or said float has different connection points for said float connector enabling different heights of said float relative to said valve shaft.

A nineteenth object of the present invention is to provide an adapter adapted for cooperation with a liquid transfer regulating means in a liquid dispenser which is not placed on a flat surface.

This nineteenth object is achieved by means of an adapter according to claim 19, wherein said valve shaft has a reduced diameter at said connection points that is smaller than a diameter of a connection surface of said float connector surrounding said valve shaft so as to allow the float to tilt at least 5 degrees relative to said valve shaft, wherein said valve shaft preferably also has bevelled surfaces adjacent to said reduced diameter at said connection points to allow said valve shaft to be made shorter without losing the tilting ability of said float.

A twentieth object of the present invention is to provide an adapter adapted for cooperation with a liquid transfer regulating means comprising a float fitting into many of the existing liquid dispensers on the market.

This twentieth object is achieved by means of an adapter according to claim 20, wherein said float has a maximum dimension of 170 mm and forms a central opening having a diameter greater than 70 mm.

A twenty-first object of the present invention is to provide a complete adapter assembly for connecting a removable liquid container to a liquid dispenser which can provide the same advantages as the adapter according to the invention.

This twenty-first object is achieved by means of an adapter assembly according to claim 21, which comprises at least an adapter according to the invention.

A twenty-second object of the present invention is to provide an adapter assembly which offers even more advantages than the adapter according to the invention alone.

This twenty-second object is achieved by means of an adapter assembly according to claim 22, which further comprises a liquid transfer regulating means, which is adapted to be mounted in a top opening of a liquid reservoir of said liquid dispenser and connected to an outlet of said feed tube via a feed tube connector so as to cooperate with and regulate liquid transfer through said adapter, wherein said feed tube is integrated into an existing liquid dispenser support of said liquid dispenser. By including such a liquid transfer regulating means in the adapter assembly, it becomes possible to use the adapter according to the invention also on a liquid dispenser having no means for controlling the liquid level in a liquid reservoir of the dispenser.

A twenty-third object of the present invention is to provide an adapter assembly including a liquid transfer regulating means which has a simple and reliable design.

This twenty-third object is achieved by means of an adapter assembly according to claim 23, in which said liquid transfer regulating means cooperating with said adapter comprises a valve shaft attached to a float connector and a float connected to said float connector, wherein said float has a buoyancy adapted to press a valve surface of said valve shaft against a valve surface of said feed tube connector so as to close an open valve area and stop liquid transfer through said adapter and feed tube into said liquid reservoir when a liquid level in said liquid reservoir is high and wherein gravity acting on said liquid transfer regulating means will keep said valve area open so that liquid can flow through said adapter and out of said feed tube into said liquid reservoir when said liquid level is low.

A twenty-fourth object of the present invention is to provide an adapter assembly including a liquid transfer regulating means in which the height of the float relative to the valve shaft can easily be adjusted to fit different liquid dispensers.

This twenty-fourth object is achieved by means of an adapter assembly according to claim 24, in which said valve shaft and/or said float has/have different connection points for said float connector enabling different heights of said float relative to said valve shaft.

A twenty-fifth object of the present invention is to provide an adapter assembly including a liquid transfer regulating means in which the float can tilt relative to the valve shaft to ensure a reliable function of the adapter assembly also when installed in a liquid dispenser placed on an uneven surface.

This twenty-fifth object is achieved by means of an adapter assembly according to claim 25, in which said valve shaft has a reduced diameter at said connection points that is smaller than a diameter of a connection surface of said float connector surrounding said valve shaft so as to allow the float to tilt at least 5 degrees relative to said valve shaft, wherein said valve shaft preferably also has bevelled surfaces adjacent to said reduced diameters at said connection points to allow said valve shaft to be made shorter without losing the tilting ability of said float.

A twenty-sixth object of the present invention is to provide an adapter assembly including a liquid transfer regulating means which has a float that fits to many of the existing liquid dispensers on the market.

This twenty-sixth object is achieved by means of an adapter assembly according to claim 26, in which said float has a maximum dimension of 170 mm and forms a central opening having a diameter greater than 70 mm.

A twenty-seventh object of the present invention is to provide a method of installing and using an adapter assembly according to the invention.

This twenty-seventh object is achieved by means of method according to claim 27, wherein said outlet of said adapter is fitted tightly around said feed tube of said liquid dispenser and wherein said removable liquid container is mounted on top of said liquid dispenser and said hollow probe part of said adapter is caused to pierce said outlet comprising a self-sealing valve or membrane of said removable liquid container to removably connect said removable liquid container to said liquid dispenser.

A twenty-eight object of the present invention is to provide a method of installing and using an adapter assembly according to a preferred embodiment of the invention.

This twenty-eight object is achieved by means of method according to claim 28, wherein said liquid dispenser support of said liquid dispenser is removed from said top opening of said liquid reservoir of said liquid dispenser, wherein said liquid transfer regulating means is connected to said outlet of said feed tube integrated into said liquid dispenser support via said feed tube connector, and wherein said liquid dispenser support with said liquid transfer regulating means connected thereto is reinserted into said top opening before fitting said outlet of said adapter tightly around said feed tube.

A twenty-ninth object of the present invention is to provide a preferred method of using an adapter assembly according to the preferred embodiment of the invention.

This twenty-ninth object is achieved by means of method according to claim 29, wherein said adapter assembly, when installed, is used for connecting removable bag-in-box liquid containers to said liquid dispenser by means of said adapter and preferably also for regulating liquid transfer from said removable bag-in-box liquid containers through said adapter to said liquid dispenser.

A thirtieth object of the present invention is to provide a particularly advantageous method of using an adapter assembly according to the invention.

This thirtieth object is achieved by means of a method according to claim 30, wherein said adapter assembly is also used for enabling text and/or images printed on one or several external box surfaces of said removable bag-in-box liquid containers to be displayed to users of said liquid dispenser.

BRIEF DESCRIPTION OF THE DRAWINGS

Additional features and advantages of the invention will be apparent from the detailed description which follows, taken in conjunction with the accompanying drawings, which together illustrate, by way of example, features of the invention; and, wherein.

Figure 1A:
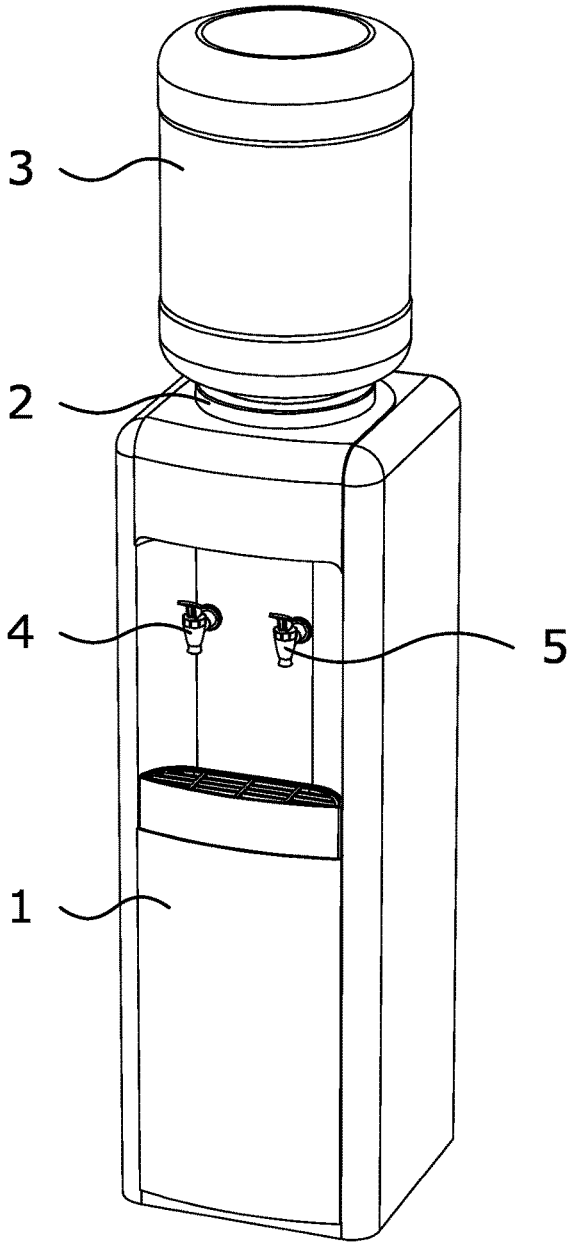
FIG. 1A is a perspective view of an example of a liquid dispenser mounted with a (5 gallon) water bottle.

Reference will now be made to the exemplary embodiments illustrated, and specific language will be used herein to describe the same. It will nevertheless be understood that no limitation of the scope of the invention is thereby intended.

DETAILED DESCRIPTION OF THE INVENTION

Basically, the present invention relates to an adapter, which is designed to transport a liquid from a removable liquid container to a sealed liquid reservoir of a liquid dispenser, and optionally also to a liquid regulating means, which is designed to control the level of liquid in a liquid reservoir inside the liquid dispenser. More specifically, this invention relates to a body which has an outlet which can sealingly be connected to the feed tube of a conventional liquid dispenser and has an inlet shaped as a probe which can sealingly be connected to a removable container with a self-sealing outlet (fitment). The body may include a support surface for the removable container. Additionally this invention relates to a floating body which is connected to the feed tube outlet of the liquid dispenser. The floating body includes parts which can regulate the liquid flow from the outlet of the feed tube into the liquid reservoir.

Basically, the adapter according to the invention comprises a body which on one side can sealingly be connected to the standardized feed tube of a liquid dispenser (e.g. a water dispenser) and on the other side has a probe which fits into an outlet comprising a self-sealing valve or membrane, which can be an outlet fixed to the flexible bag of a bag-in-box container or to another type of removable liquid container. The adapter can include surfaces to hold a bag-in-box container in a fixed position. Thus the adapter can transfer liquid from a bag-in-box container with a self-sealing membrane or valve to the (liquid) reservoir of a dispenser without any contact with the outer environment.

A solution is also provided should the adapter be used on a (liquid) dispenser which has not got a means to control the liquid level in the liquid reservoir in the case that the adapter is connected to such a dispenser. This solution is a float assembly fitted into the outlet of the feed tube of a dispenser.

Some main features of the adapter according to the invention are:

- A body chamber fitting within the recessed area around the feed tube of a (liquid) dispenser. On one side of the body there is an inlet and on the opposite side an outlet.
- The inlet side of the chamber is probe shaped and fits to a removable liquid container by piercing through a self-sealing membrane, e.g. the LMS SimpliSeal, or a duckbill (or other type of) valve mounted in the outlet of the removable liquid container.
- The outlet side of the chamber has a cylindrical shape and fits onto the feed tube of a (liquid) dispenser. The area around the outlet is made of an elastomeric material, or a material with similar characteristics, to create an air and liquid-tight connection between the adapter and the feed tube.
- The inlet side of the body chamber can include surfaces to support and/or hold a bag-in-box container in a fixed position on top of the body chamber.

The same functionality of the adapter can be obtained by combining and/or separating different parts of the adapter and assembling these in a different way and it will nevertheless be understood that no limitation of the scope of the invention is thereby intended.

Some main features of the float assembly adapted to cooperate with the adapter according to the invention are:

- A floating volume fitting into the (liquid) reservoir. This floating part is made of material with a high buoyancy, complies with FDA food regulations and is liquid resistant in particular to water.
- An element connecting the floating part to the valve shaft, the float connector. This part could be integrated into the floating part, but using two parts creates multiple connection possibilities.
- An element connecting into the outlet side of the feed tube connector of a liquid dispenser such as a water cooler. This part is made of an elastomeric material, or a material with similar characteristics, and is one side of the valve.
- A valve shaft. The top end of the shaft fits into the feed tube connector and the bottom end of the shaft connects to the float connector. Fluid will not be able to pass through the feed tube when the connection surface of the valve shaft is flush against the bottom of the feed tube connector.

The same functionality of the float assembly can be obtained by combining and/or separating different parts of the float assembly and assembling these in a different way and it will nevertheless be understood that no limitation of the scope of the invention is thereby intended.

Figure 1B:
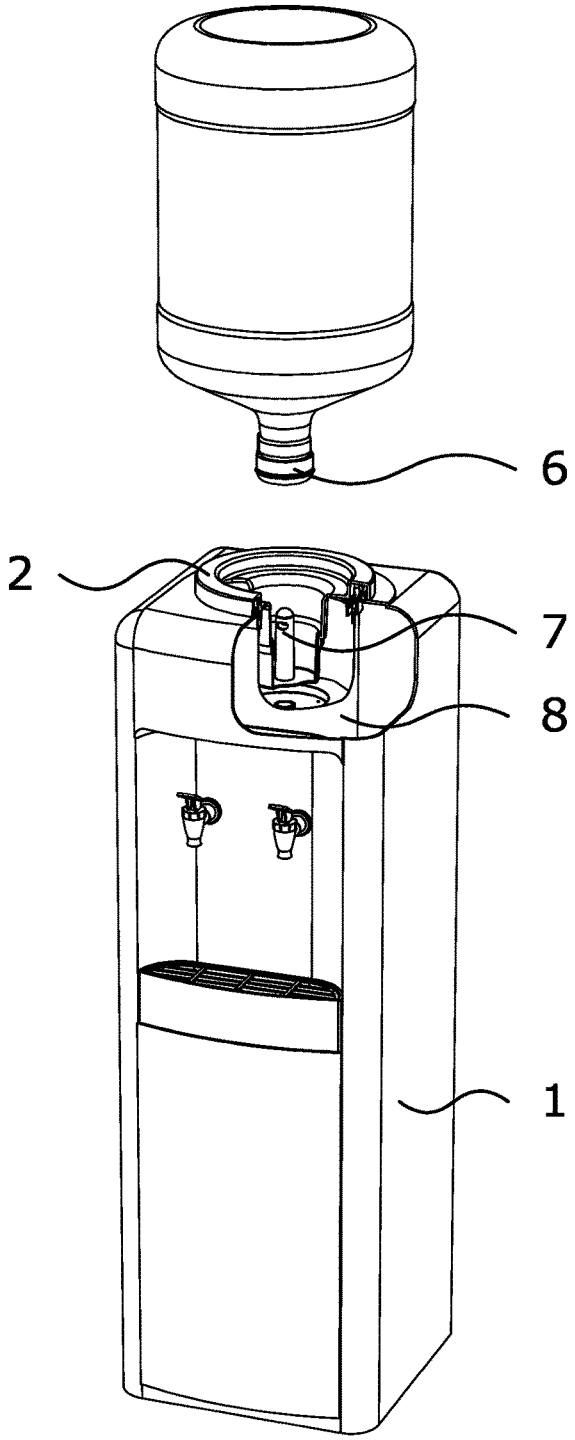
FIG. 1B is an assembly view similar to that of FIG. 1A, but partly showing some inner parts of the liquid dispenser and in specific the feed tube part of the liquid dispenser which connects to a non-spill water bottle cap.

The apparatus as illustrated in FIGS. 1A and 1B is a water dispenser, as can be found in many offices, work places and homes world wide. The illustrated water dispenser 1 comprises a water dispenser support 2 upon which the water bottle 3 is mounted in an inverted position onto a feed tube 7 which is most often integrated into the water dispenser support 2. The housing of the dispenser 1 includes a reservoir 8 for containing a supply of water which can be dispensed on demand via one or more faucet valves. Water flows from the bottle 3 through the feed tube 7 to the water reservoir 8. Water can be dispensed from the dispenser through the water outlet in the dispenser housing which here is embodied by ambient faucet valve 4 and cold faucet valve 5. The water from cold faucet valve 5 is supplied from the water reservoir 8, while the water from ambient faucet valve 4 is not cooled and is supplied from the bottle 3 directly. Some water dispensers can, in addition to cold and/or ambient water, also supply heated water. In that case, the water dispenser 1 will include a heating system for water, and a hot water reservoir.

Figure 2A:
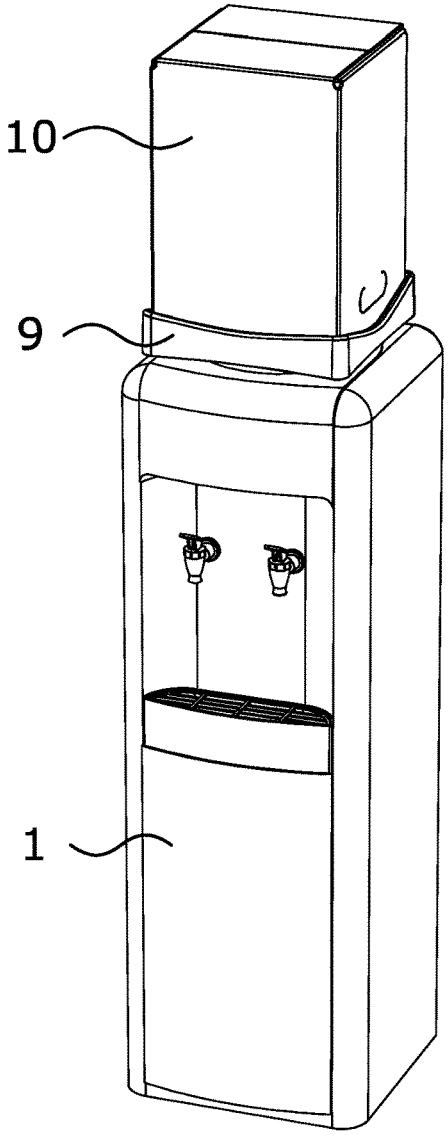
FIG. 2A is a perspective view of a liquid dispenser assembled with the removable liquid container adapter and a removable liquid container in accordance with a preferred embodiment of the present invention.

FIG. 2A shows a preferred embodiment of a liquid transfer means, which as from now on is referred to as "adapter" 9, positioned on top of an existing liquid dispenser 1, in place on the liquid dispenser support 2, and supporting a removable liquid container 10 on top of the liquid dispenser 1 instead of the water bottle 3 shown in FIG. 1A. As an example, the removable liquid container has been illustrated as a bag-in-box container and the removable liquid container may therefore also be referred to as a 'bag-in-box container' or 'bag-in-box liquid container' in the present description. The bag-in-box container 10 in the shown embodiment is mounted on and received by an adapter 9 sized and configured to receive and support the bag-in-box container 10 thereon. The adapter 9 will fit to different types, configurations, and brands of liquid dispensers which use a feed tube 7 to connect to a water bottle 3. The adapter 9 and optionally a liquid transfer regulating means 11 can be connected to an existing water dispenser without requiring any alteration to it, neither will the use of special tools be necessary.

Figure 2B:
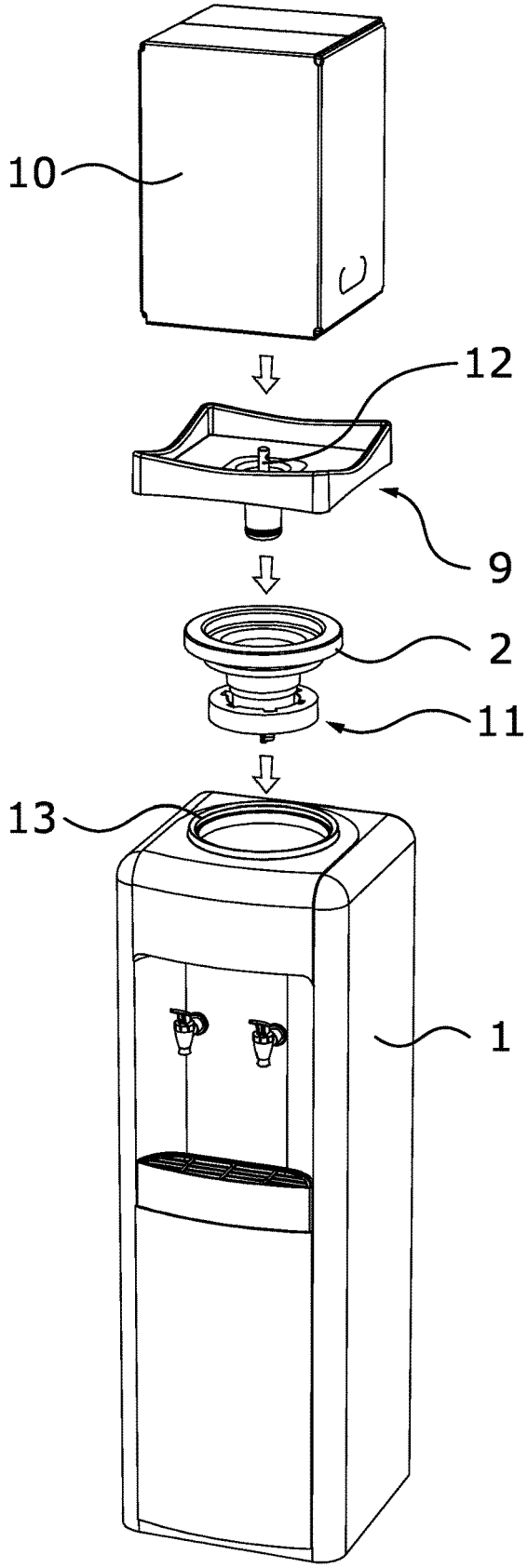
FIG. 2B is an exploded perspective view of FIG. 2A showing a liquid dispenser, the liquid transfer regulating means, the removable liquid container adapter and a removable liquid container.

FIG. 2B is an exploded view of FIG. 2A which shows a liquid transfer regulating means 11 which is assembled to the liquid dispenser support 2 to be mounted into the top opening 13 of the liquid reservoir of a liquid dispenser 1. In the shown embodiment, the liquid transfer regulating means 11 must be assembled and placed into the liquid dispenser prior to using the adapter 9 with a removable liquid container 10 as the liquid will otherwise continue to flow out of the bag-in-box container 10 into the liquid reservoir 8 until the bag-in-box container 10 is empty which could cause the liquid reservoir 8 to overflow. Some liquid dispensers include means for regulating the liquid transfer and the liquid transfer regulating means 11 may then not be necessary to use with the adapter 9. Examples of patents disclosing water transfer regulating means for water dispensers are WIPO Pat. No. 2012/165774 (A2), U.S. Pat. Nos. 2007/0131709 (A1), 2012/074166 (A1), 2003/094213 (A1), Korean Patent KR20120025952 (A) and European Patent EP1506935 (A1).

When the liquid transfer regulating means 11 of the liquid dispenser are in place, the adapter 9 is connected to the liquid dispenser support 2 to create the possibility to connect a bag-in-box container 10 via the probe 12 of the adapter 9 to the liquid dispenser 1.

Figure 3A:
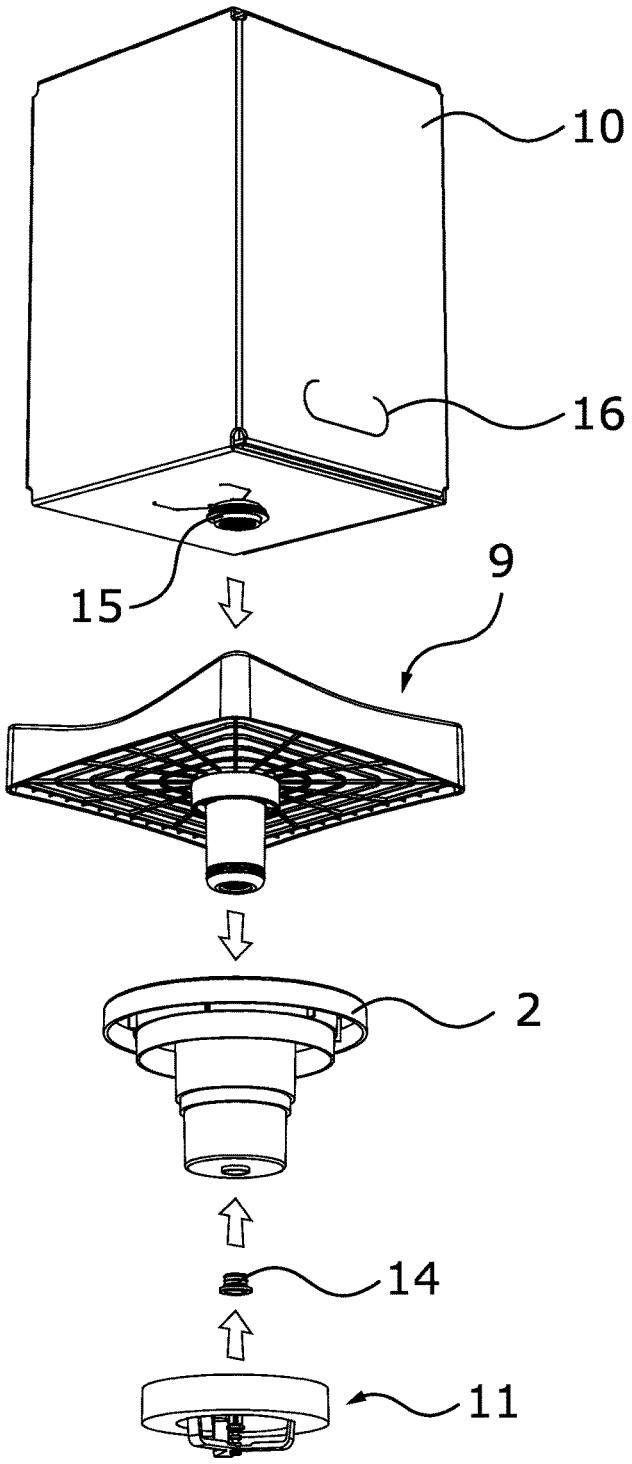
FIG. 3A is an exploded perspective exploded view from below showing the parts of the liquid transfer regulating means, the liquid dispenser support of a liquid dispenser, the removable liquid container adapter and a removable liquid container.

FIG. 3A shows an exploded view obliquely from below. More specifically, it is shown how the liquid transfer regulating means 11 is connected to the liquid dispenser support 2 with a feed tube connector 14. Further shown is the bottom surface of the bag-in-box container 10, where the fitment, or outlet 15 with a self-sealing dispensing valve which will be pierced by the probe 12 of the adapter 11 is shown. Such fitments are available from DS Smith, Scholle and Liquibox. The preferred placement of the fitment is in the absolute centre of the bottom surface of the bag-in-box container 10, but alternative positions of the fitment on the bottom surface or other surfaces of the bag-in-box container are not excluded from the invention.

Figure 3B:
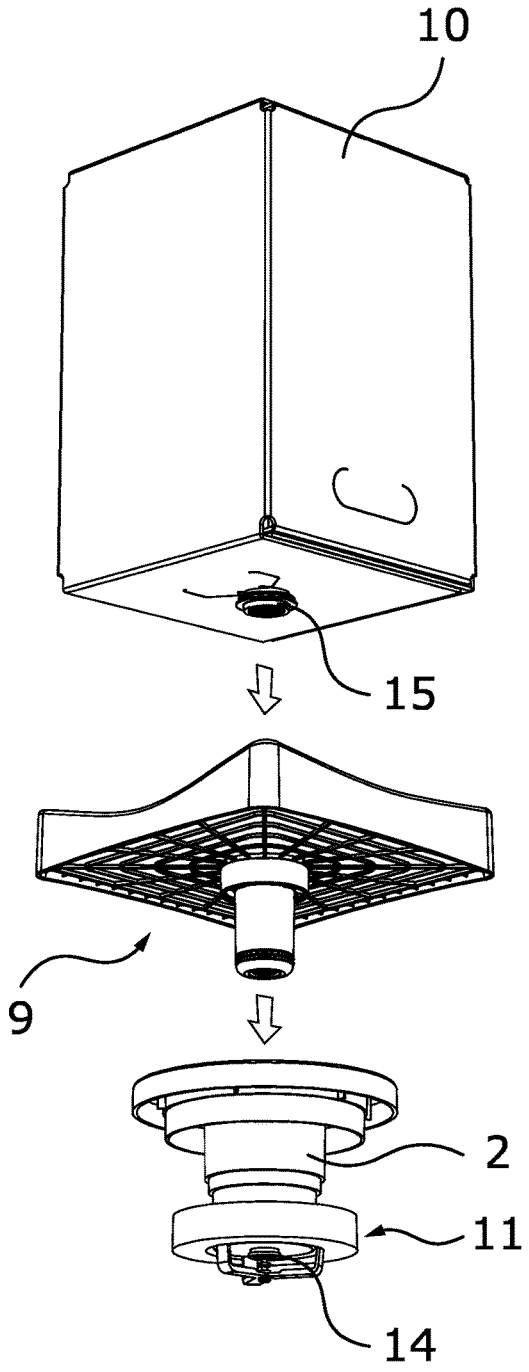
FIG. 3B is a view similar to that of FIG. 3A, but in this case showing the liquid transfer regulating means assembled to the liquid dispenser support.

FIG. 3B is a similar view to FIG. 3A, showing the liquid transfer regulating means 11 and the feed tube connector 14 assembled to the liquid dispenser support 2.

Figure 4A:
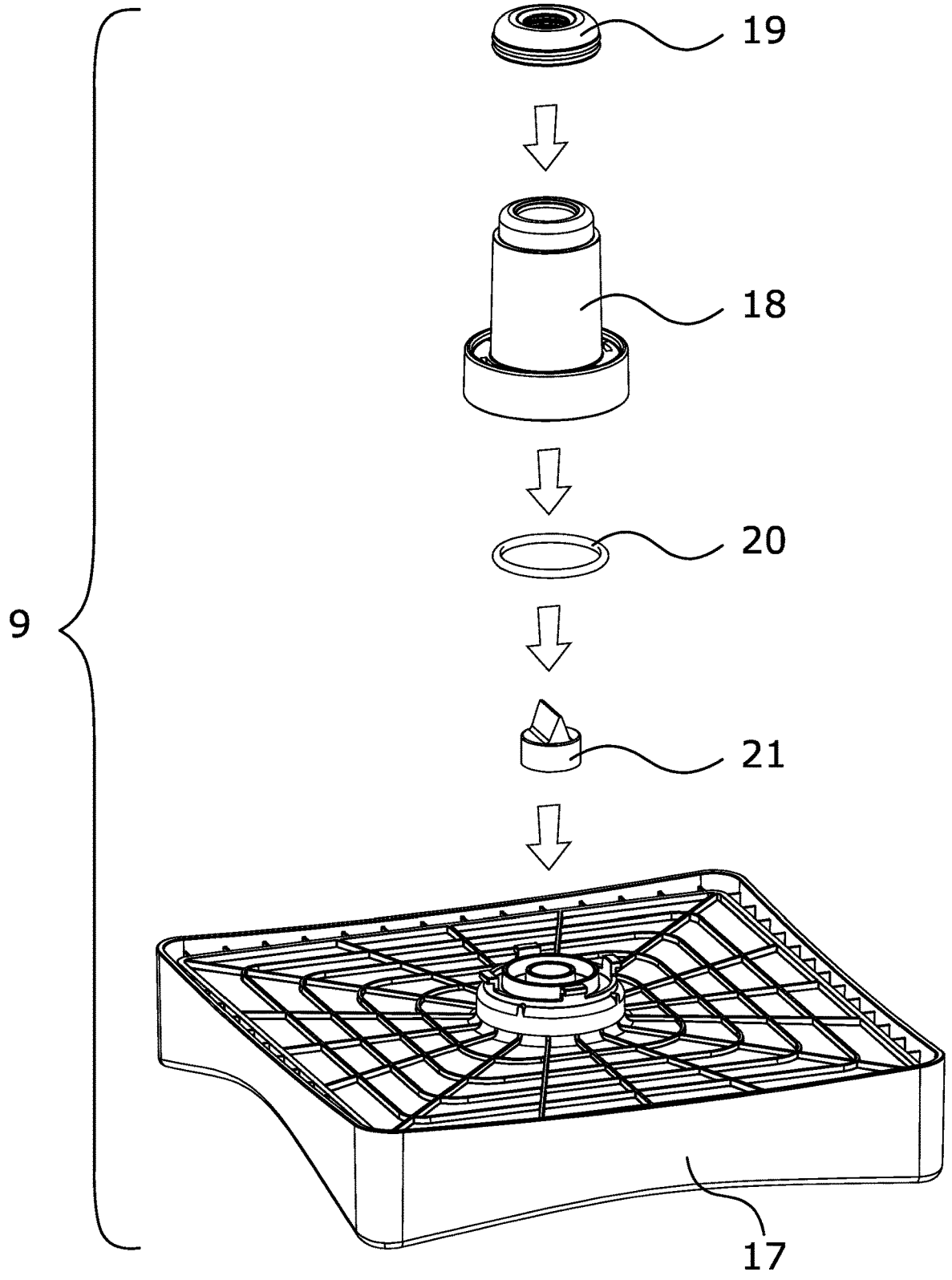
FIG. 4A is an exploded perspective bottom view of the parts of the removable liquid container adapter.

FIG. 4A shows an exploded view of the adapter 9, which as previously mentioned is a means for transferring liquid from a removable liquid container, e.g. a bag-in-box container, with an outlet 15 with a self-sealing membrane or valve, to the liquid reservoir 8 of a conventional liquid dispenser 1, which uses a feed tube 7 as connection between the liquid dispenser 1 and the standard non-spill water bottle caps 6. The adapter 9 in the shown embodiment consists of a holder for a bag-in-box container, further on also referred to as a "box connector" 17, a dispenser connector 18, a feed tube seal 19, a packing 20 and a duckbill valve 21. The feed tube seal 19 is fixed to the dispenser connector 18 and mounted with a packing, in the figure drawn as an O-ring 20, to the box connector 17, creating an enclosed area to transfer liquid through the adapter outlet 25 at the bottom of the dispenser connector 18. The packing is made of an elastomeric material or a material with similar characteristics. The duckbill valve 21 is added to the assembly to prevent liquid flowing back into the bag-in-box container 10. All the parts of the adapter 9 are made of (food grade) materials suitable for contact with drinking water and will comply to government regulations, like FDA and EC No. 1935/2004. The invention is not restricted to the configuration of the adapter in the shown embodiment, other configurations with different parts creating the same or similar functionality as the described configuration are not excluded from the invention.

Figure 4B:
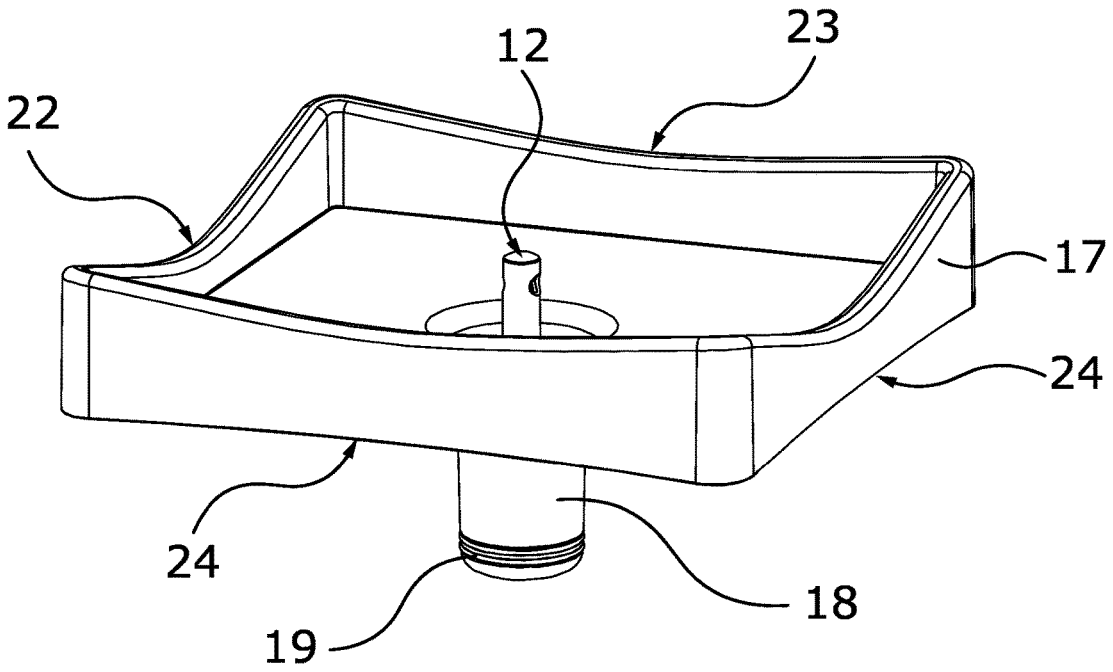
FIG. 4B is a perspective top view of the assembled removable liquid container adapter.
Figure 4C:
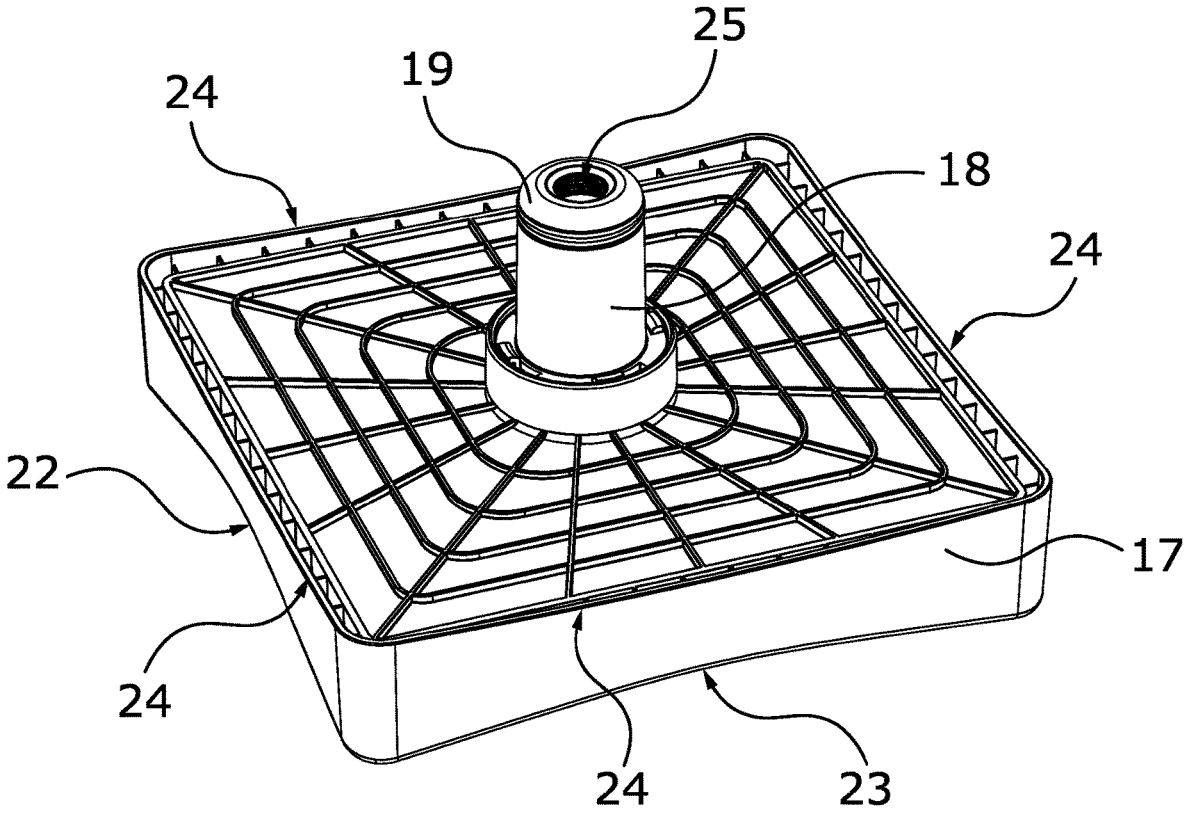
FIG. 4C is a perspective bottom view of FIG. 4B.

In FIGS. 4B and 4C it is illustrated that the sides of the box connector 17 are lower in the centre then in the corners. In this way the cut-outs for the handles 16 of the bag-in-box carton can be placed closer to the bottom of the bag-in-box carton, which decreases the height to lift the bag-in-box container 10 onto the liquid dispenser 1. The front and back of the box connector 17 do not require this decreased height and the shape shown in the illustration is purely for aesthetic reasons. The bottom edges 24 of the box connector 17 are lower in the centre than in the corners which gives the box connector 17 a somewhat thinner impression and is purely for aesthetic reasons. The optimal shape of a bag-in-box container 10 to be used with the adapter 9 is that it has equal width and depth. The height of the bag-in-box container 10 is variable creating a variety of volumes. The outlet (fitment) connected to the flexible bag is preferably positioned in the exact centre of the bottom surface of the bag-in-box container 10. A bag-in-box container 10 with a square bottom (and top) surface has no fixed orientation of the sides surfaces. The most optimal size of the width and depth the bottom (and top) surface is between 225 and 235 mm, this size gives optimal packaging sizes for transport and storage on standard pallets, for both US and EU format. It should be clear that alternative sizes of the surfaces of the bag-in-box container 10 are not excluded from the invention. The shape and size of the adapter 9 is optimized to fit the optimal sizes of a bag-in-box container. It should be clear that alternative sizes of the surfaces of the adapter 9 are not excluded from the invention.

Figure 4D:
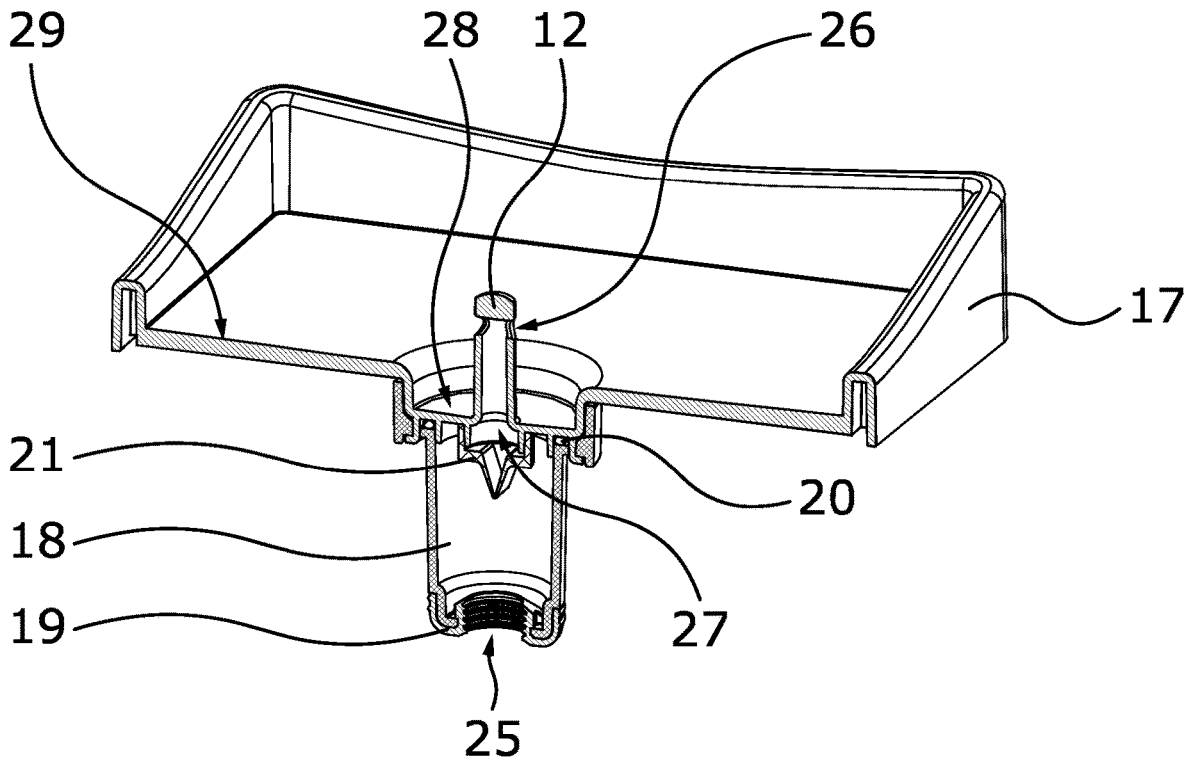
FIG. 4D is a sectioned view of FIG. 4B.
Figure 10:
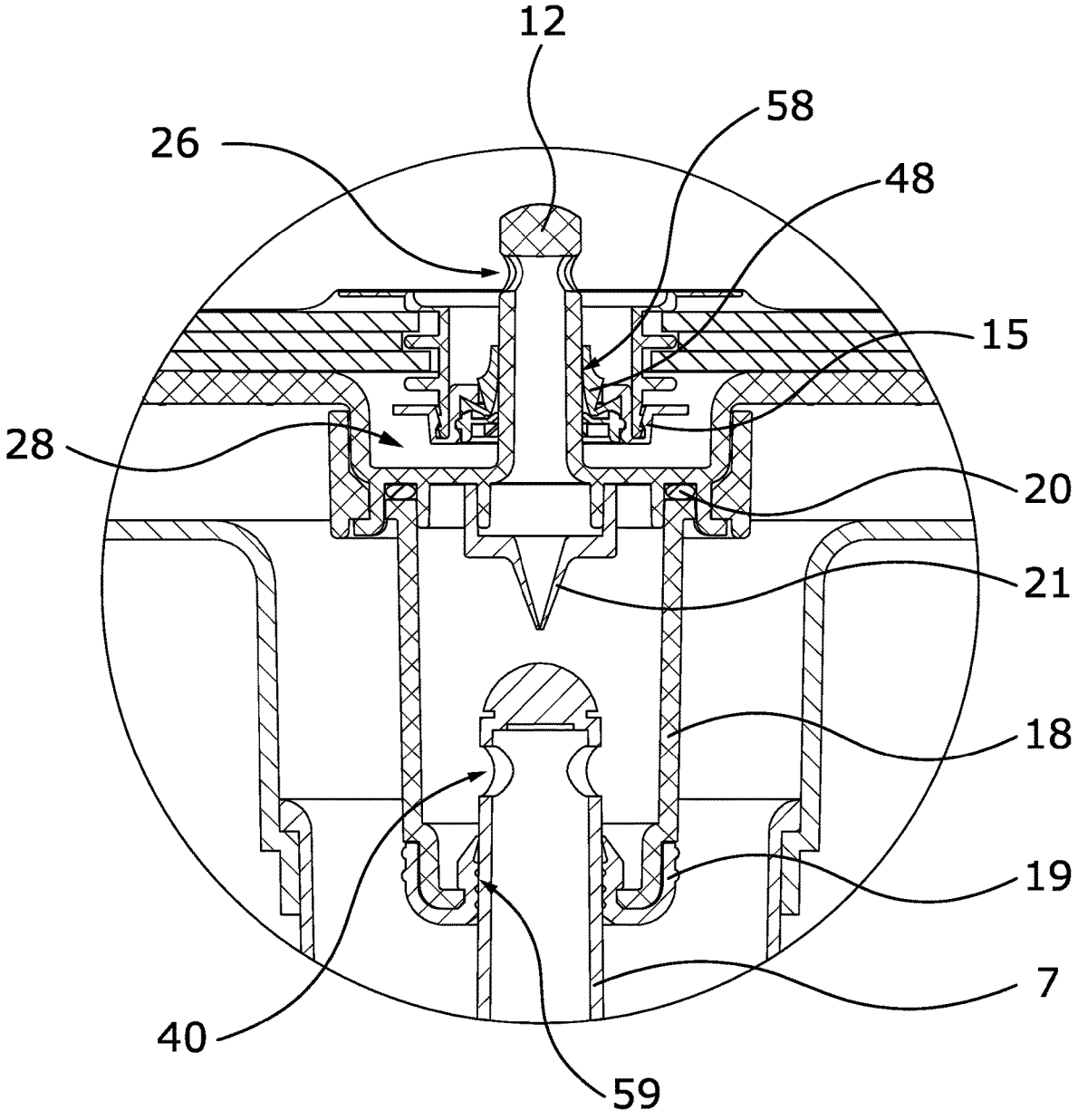
FIG. 10 is an enlarged detail view of the parts of the liquid transfer means.

FIG. 4D shows a sectioned view of the assembled parts of the adapter 9. More particularly, it is shown that there are inlets on the probe 12—defined as probe inlets 26—making it possible for liquid to transfer through the probe 12 out of the probe outlet 27 into the dispenser connector 18 and from there out of the adapter outlet 25 into the feed tube 7 of a liquid dispenser. The preferred shape of the probe 12 shown in the drawings has a circular shape with a closed top and two holes on the side close to the top of the probe to let liquid enter the probe. The preferred shape probe 12 has a closed top to prevent dirt entering into the probe while there is no bag-in-box container 10 fitted onto the adapter 9. It should be clear, however, that alternative liquid inlet points, e.g. an opening on the top of the probe 12 are possible and are not excluded from the invention. The dispenser connector 18 is connected to the box connector 17 with an O-ring 20 to make the created enclosed area air- and liquid tight. The feed tube seal 19 is press fitted into the dispenser connector 18. A duckbill valve 21 is attached to the probe outlet 27 and ensures that liquid cannot return into a bag-in-box container 10. The valve is not a required part for the functionality of the invention, but does increase the functionality of the invention. Different types of duckbill valves or other non-return valves can be used in different configurations in the invention and these are not excluded from the invention. The recessed area 28 around the probe 12 of the box connector 17 allows the outlet 15 with a self-sealing valve or membrane of a bag-in-box container 10 to fit into this area whilst the bottom surface of the bag-in-box container rests on the support surface 29 of the box connector 17. FIG. 10 shows a more detailed view of how a self-sealing outlet 15 fits into the recessed area 28 around the probe 12.

Figure 5A:
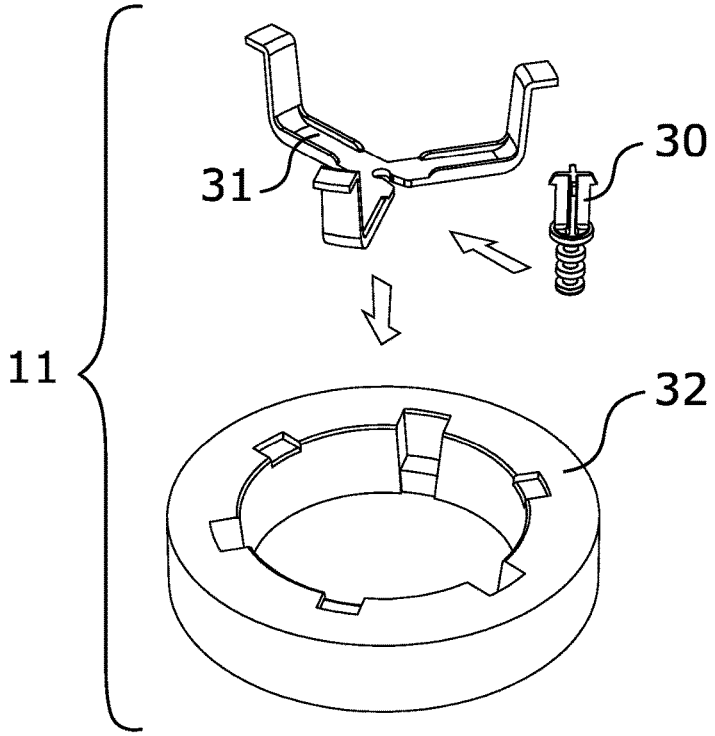
FIG. 5A is an exploded perspective bottom view of the parts of the liquid transfer regulating means.

In FIG. 5A it is shown how the parts of a liquid transfer regulating means 11 intended to cooperate with the adapter 9 should be assembled. The valve shaft 30 is attached to the float connector 31 which is connected to the float 32.

Figure 5B:
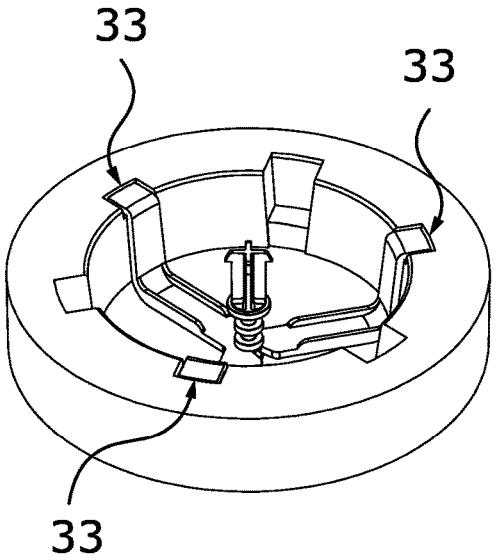
FIG. 5B is a perspective top view of the liquid transfer regulating means with the float part assembled in the most compact configuration.
Figure 5C:
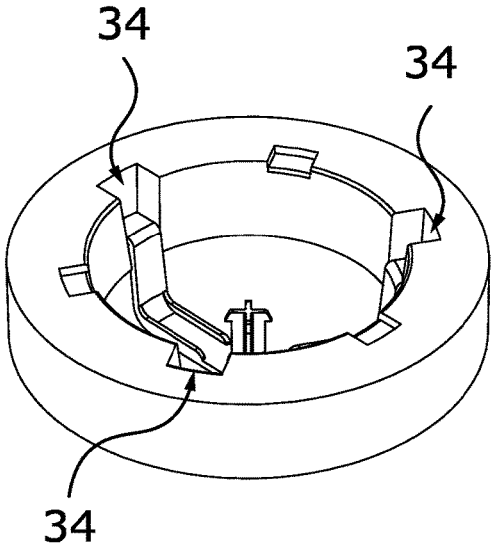
FIG. 5C is a perspective top view of the liquid transfer regulating means with the float part assembled in the most extended configuration.
Figure 5D:
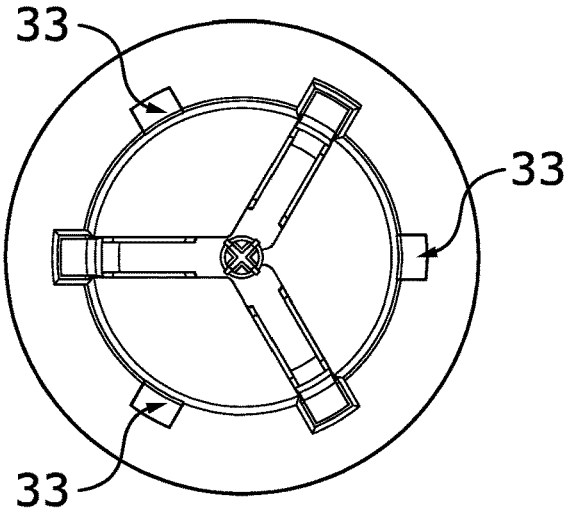
FIG. 5D is a top view of FIG. 5C.
Figure 5E:
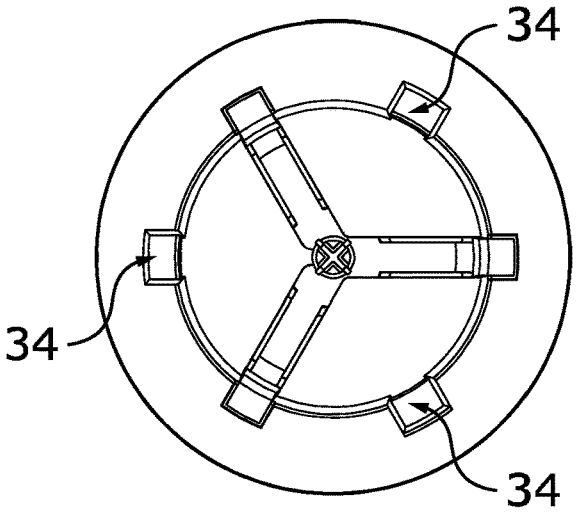
FIG. 5E is a top view of FIG. 5B.
Figure 5F:
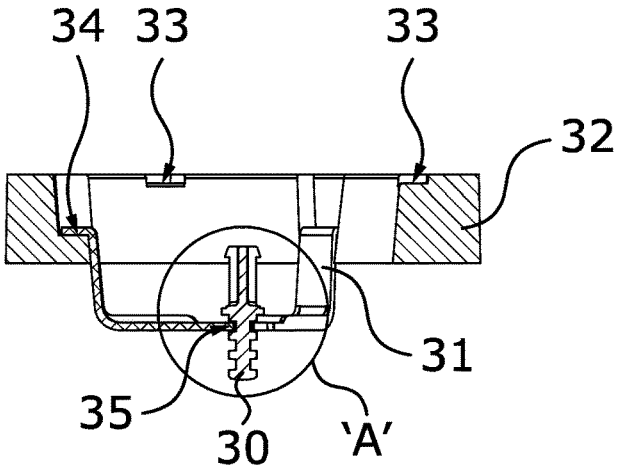
FIG. 5F is a sectioned side view of FIG. 5D.
Figure 5G:
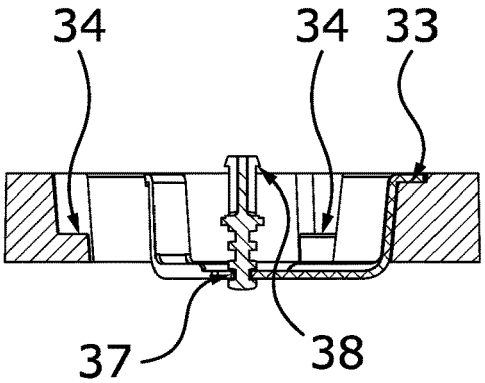
FIG. 5G is a sectioned side view of FIG. 5E.

FIG. 5B, FIG. 5E and FIG. 5G show the liquid transfer regulating means 11 with the float 32 connected to the float connector 31 in the upper connection slots 33 and FIG. 5C, FIG. 5D and FIG. 5F show the liquid transfer regulating means 11 with the float 32 connected to the float connector 31 in the lower connection slots 34. Having the possibility to fit the float connector 31 to the float 32 at different heights gives the liquid transfer regulating means 11 different sizes and therefore the possibility to be mounted into different types of liquid dispensers. The cut-outs of the slots in the float 32 to connect the float connector 31 to the float 32 are only two examples of heights and positions, other configurations are possible and these are not excluded from the invention.

FIG. 5F and FIG. 5G show two connection possibilities for how the valve shaft 30 can be connected to the float connector 31. The valve shaft 30 has different connection points to create a variation of distances how close the float connector 31 will be positioned to the feed tube seal 19 and thus to the bottom of the feed tube 7. FIG. 5F illustrates a configuration where the valve shaft 30 is connected at a minimum connection position 35 to the float connector 31 and FIG. 5G illustrates a configuration where the valve shaft 30 is connected at a maximum connection position 37 to the float connector 31.

Figure 5H:
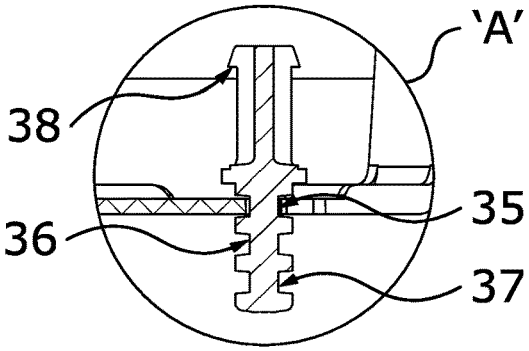
FIG. 5H is an enlarged detail view of portion 'A' shown in FIG. 5F.

FIG. 5H shows the detail 'A' of FIG. 5G and shows in more detail the three possible connection positions of the valve shaft 30—minimum connection position 35, medium connection position 36 and maximum connection position 37. Fitting these parts at different heights gives the liquid transfer regulating means 11 the possibility to be mounted into a variety of feed tube outlets of liquid dispensers and also creates additional variations of height and positions of the liquid transfer regulating means 11 creating more possibilities for mounting into different types of liquid dispensers 1. More or less than three connection points may be provided on the valve shaft and these are not excluded from the invention.

Figure 5I:
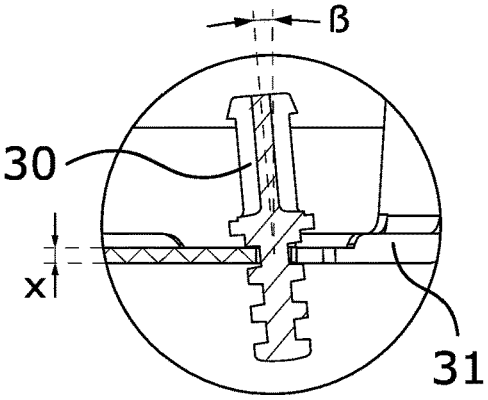
FIG. 5I shows the same detail as in FIG. 5H, but showing the valve shaft under an angle.

FIG. 5I shows the detail 'A' under the circumstance that the liquid dispenser 1 is not placed on a flat surface but under angle β which causes the valve shaft 30 to also have an angle β in relation to the vertical axis of the liquid dispenser 1 (which is perpendicular to the liquid level in the liquid reservoir 8). The diameter of the axis of the valve shaft 30 at the connection points (35, 36 and 37) is smaller than the diameter of the connection surface of the float connector 31. The connection will therefore not be a fixed connection, but will allow the float connector 31 to rotate with maximum angle β around the valve shaft 30 without the shaft receiving a non-axial force from the float connector 31.

All FIG. 6 illustrate examples of the feed tube 7 part of the liquid dispenser support 2 of a liquid dispenser 1. The figures in particular show how the feed tube connector 14 is assembled to the probe outlet 27 (see FIG. 4D) and how the valve shaft 30 is fitted into the feed tube connector 14. The float connector 31 and float 32 are not shown in these illustrations to simplify the drawings.

The top part of the valve shaft 30 has a cross shaped body so that liquid can run past the shaft. The top part of the crossed shaped part 39 has a slightly larger diameter then the lower part creating a stop surface 38. At the end of the cross shaped part there is a cylindrical surface 42 which fits perfect against the plane surface of cylindrical surface 43 of the feed tube connector. The lower part consists of an inner axis 45 and an outer axis 46. In this example the valve axis has three connections points (35, 36 and 37) as illustrated. Other numbers of connection points can be used in the invention and such embodiments are not excluded from the invention.

Figure 6A:
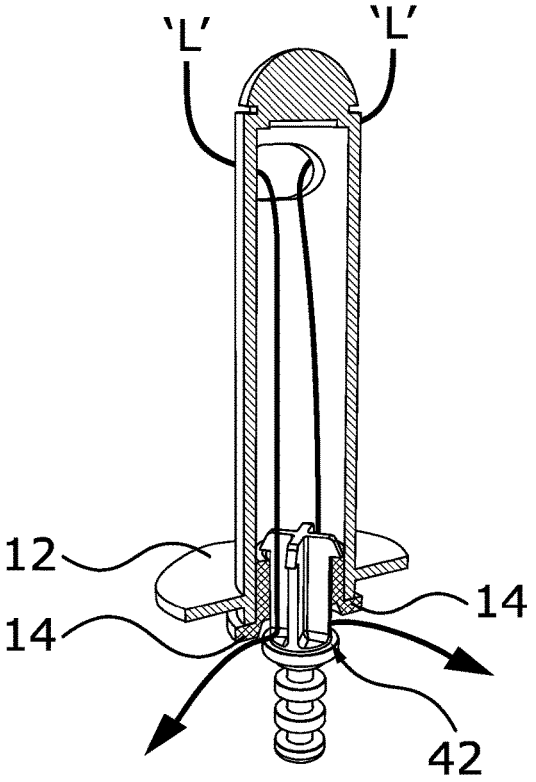
FIG. 6A is a sectioned perspective top view of the feed tube detail of a liquid dispenser support, feed tube connector and valve shaft in 'open' position.
Figure 6B:
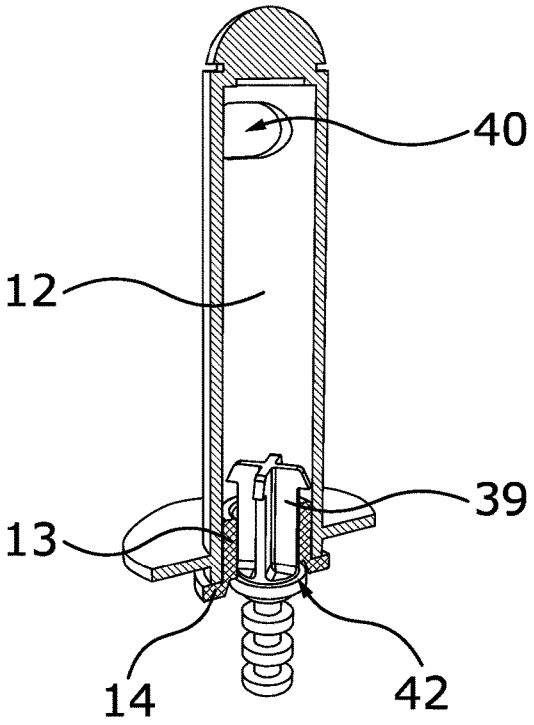
FIG. 6B is the same view as FIG. 6B, but with the valve shaft in 'closed' position.
Figure 6C:
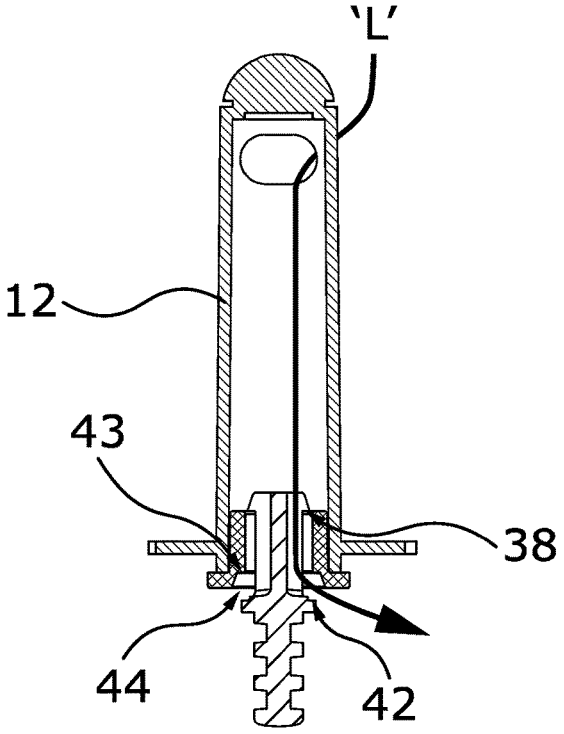
FIG. 6C is a front view of FIG. 6A.
Figure 6D:
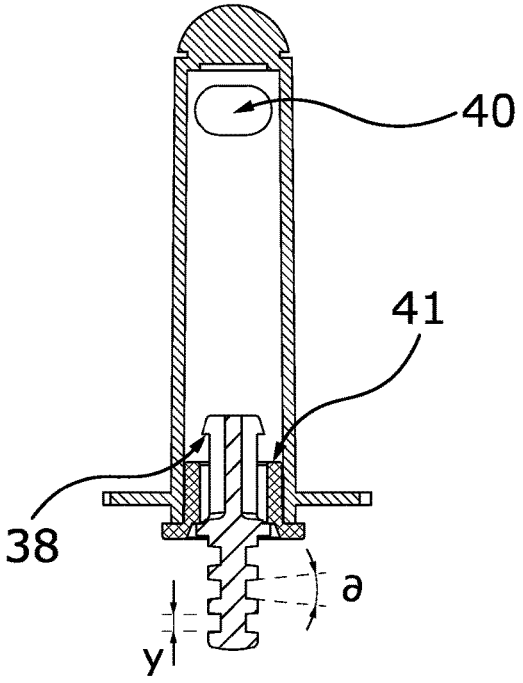
FIG. 6D is a front view of FIG. 6B.
Figure 6E:
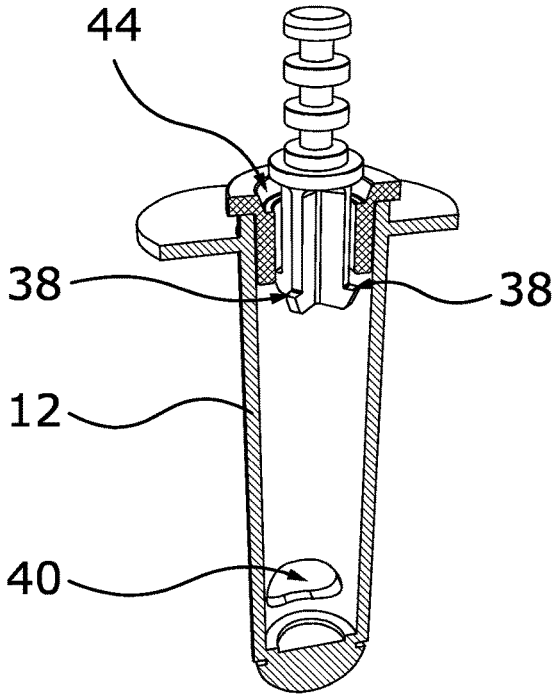
FIG. 6E shows the same as in FIG. 6A but from a sectioned perspective bottom view.
Figure 6F:
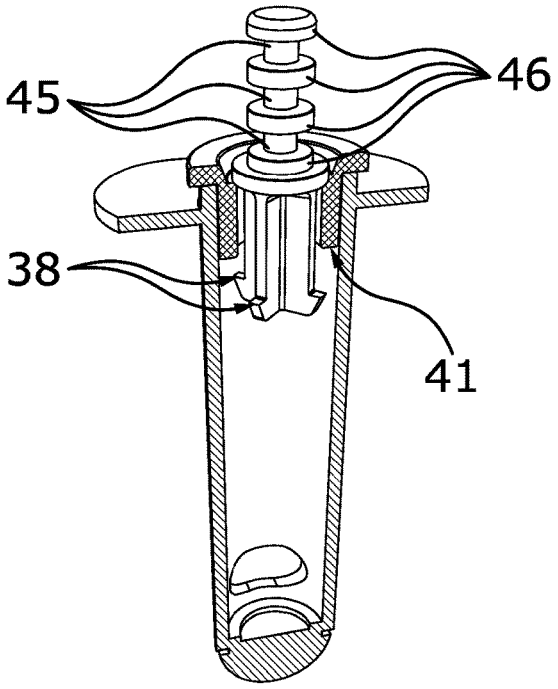
FIG. 6F shows the same as in FIG. 6B but from a sectioned perspective bottom view.
Figure 6G:
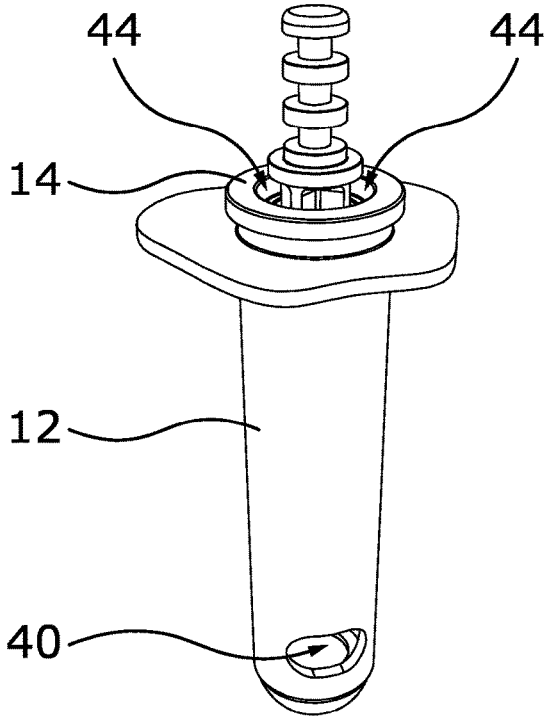
FIG. 6G is a non-sectioned view of FIG. 6E.
Figure 6H:
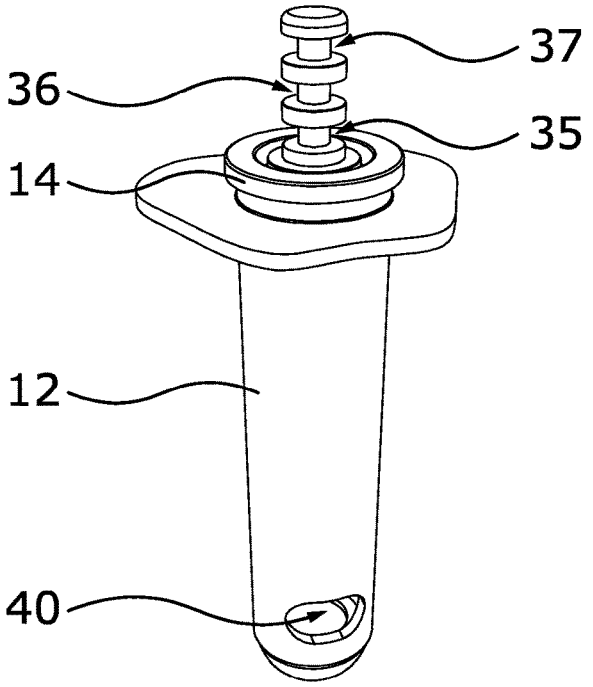
FIG. 6H is a non-sectioned view of FIG. 6F.

An 'open' position of the valve shaft 30 in the assembly is shown in FIGS. 6A, 6C, 6E and 6G. In this configuration the valve shaft is resting its stop surfaces 38 on to the top surface of the feed tube connector 14 as illustrated in FIGS. 6A and 6C. The 'open' position is the natural configuration of the assembly as the gravity force on the liquid transfer regulating means 11 will keep the valve area open 44 so that liquid can flow out of the feed tube 7. In FIGS. 6A and 6C the arrows marked with 'L' show how a liquid can flow from the probe inlet 26 past the crossed shaped part 39 of the valve shaft through the feed tube connector 14 into a liquid reservoir 8 of a dispenser. FIG. 6G shows the open valve area 44 from a bottom perspective view.

A 'closed' position of the valve shaft 30 in the assembly is shown in FIGS. 6B, 6D, 6F and 6H. When liquid runs through the feed tube 7 into the liquid reservoir 8 the buoyancy of the float 32 will push the liquid transfer regulating means 11 further into the feed tube connector 14 until a valve surface 42 of the valve shaft is pressed against a valve surface 43 of the feed tube connector 14 and thus closes the open valve area 44 and stops liquid flowing through the feed tube 7 into the liquid reservoir 8. When liquid is taken from the liquid dispenser 1 the liquid level in the liquid reservoir 8 will sink and the liquid transfer regulating means 11 will follow downwards according to this liquid level. This will open up the valve area 44 and liquid will flow out of the bag-in-box container 10 through the feed tube 7 into the liquid reservoir 8.

In FIG. 6D an angle ∂ is illustrated between the surfaces of the connection position 36 defining how many degrees float connector 31 can rotate freely around the inner valve shaft axis 45. Angle ∂ is equivalent to twice the angle β. The distance 'y' between the angled surfaces is larger than the distance 'x' of the float connector 31 shown in detail in FIG. 5I enabling float connector 31 to rotate freely around the inner valve shaft axis 45. The same angle ∂ and distance 'y' apply to the surfaces of the other connection points 37, 38 of the valve shaft.

Figure 7A:
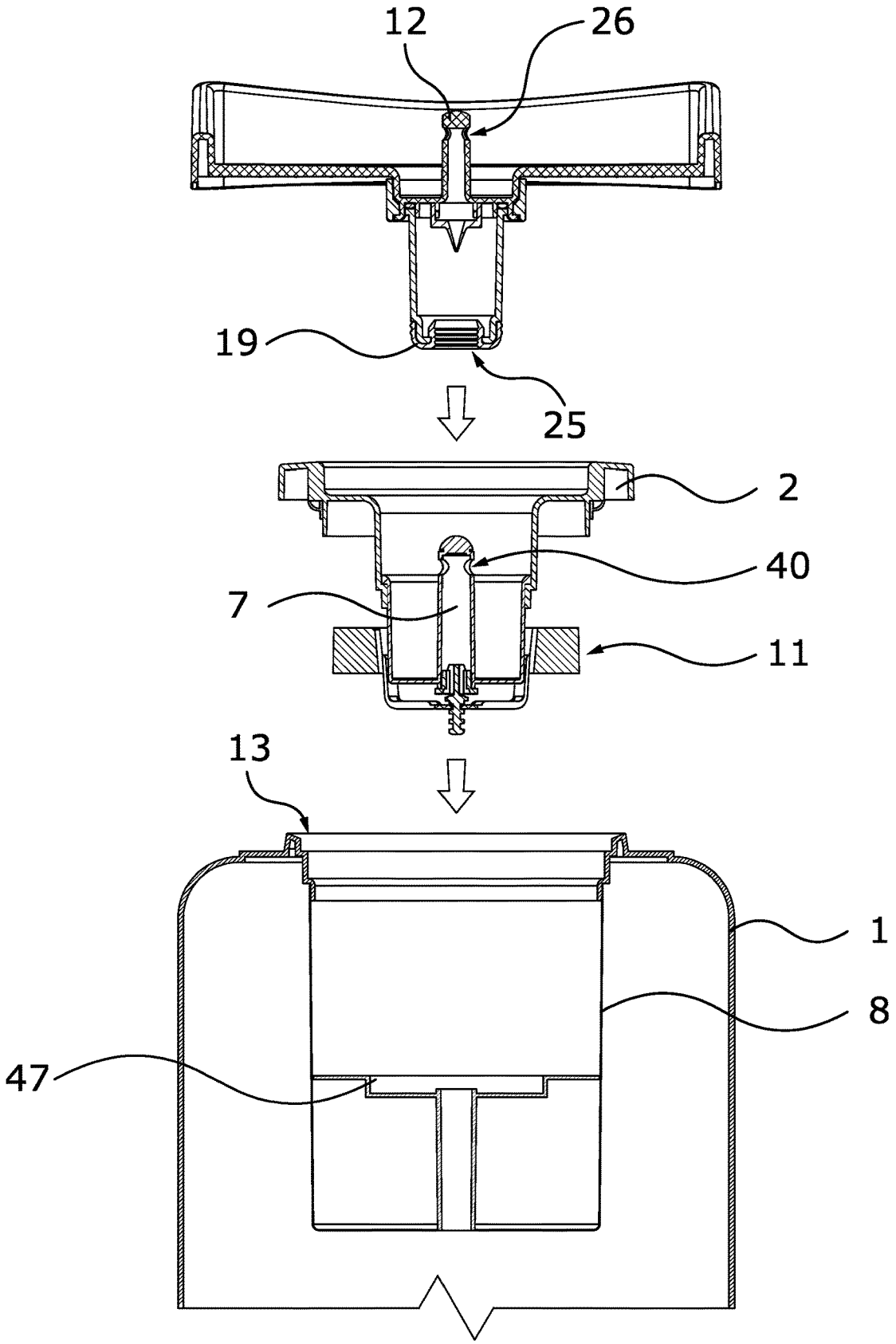
FIG. 7A is a sectioned front view of FIG. 2B but without the removable liquid container.
Figure 7B:
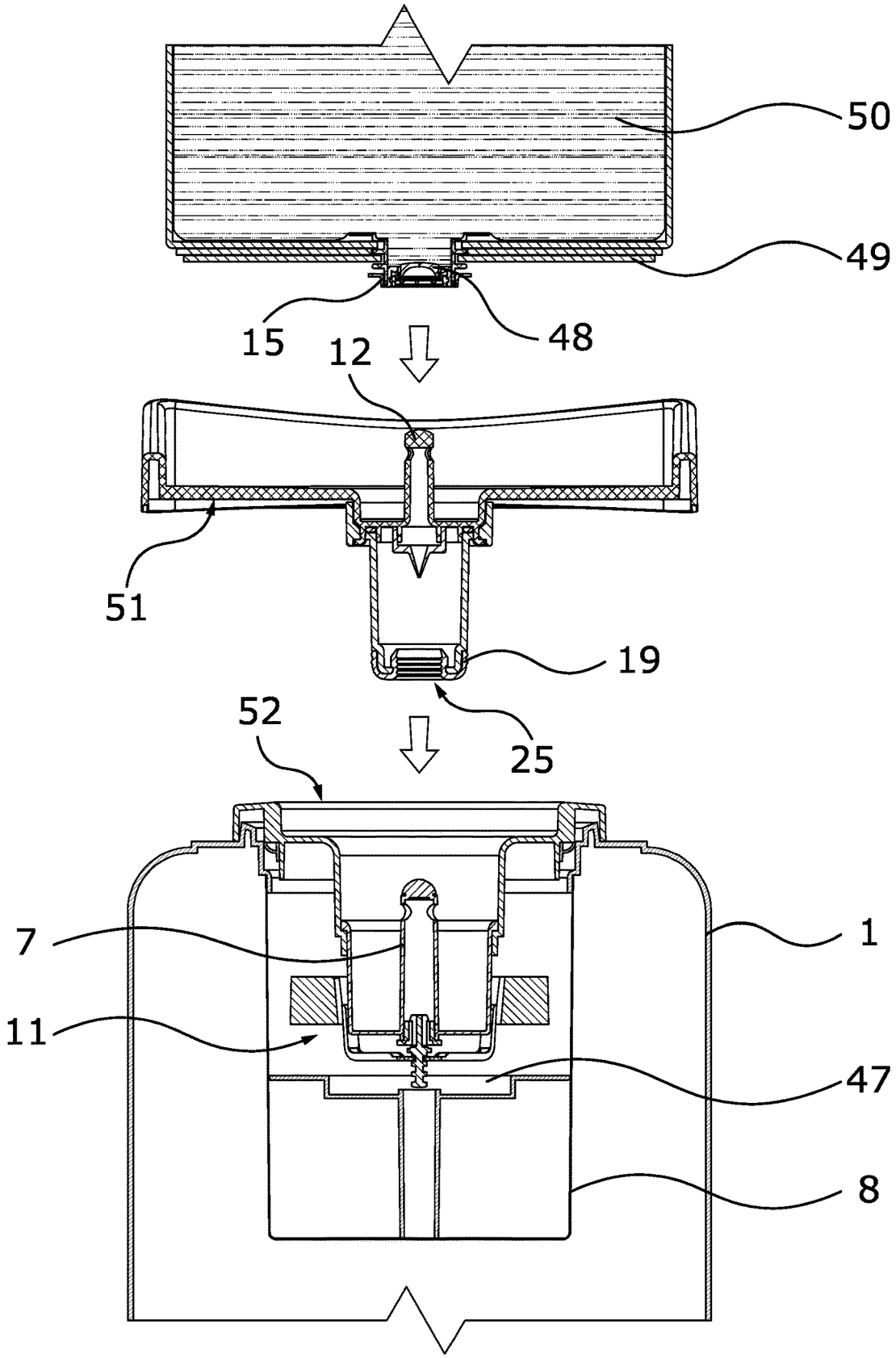
FIG. 7B is a sectioned front view similar to that of FIG. 7A, but showing the liquid transfer regulating means mounted into the liquid dispenser and showing a schematic section of a removable liquid container.

FIG. 7A is an exploded sectioned front view showing schematically some of the inner parts of a liquid dispenser 1, the assembled liquid transfer regulating means 11 connected to the liquid dispenser support 2 and the adapter 9. More specifically, it illustrates an example of a baffle 47, a common part of a liquid dispenser 1, which is required in liquid dispensers with the option to serve both cold and ambient water. Liquid dispenser baffles come in different sizes and designs. All have the same function namely separating the supplied water from cold water, hot water, or room temperature water respectively. The baffle 47 can create a very tight area between baffle 47 and bottom of the liquid dispenser support 2 as shown in FIG. 7B. The various connection possibilities of the parts of the liquid transfer regulating means 11, as described previously, will create various options for the parts to fit into such a tight area.

FIG. 7B is similar to FIG. 7A but shows the liquid transfer regulating means 11 mounted into the liquid dispenser 1. In addition a bag-in-box carton 49 with a flexible bag 50 and an outlet 15 with a self-sealing valve 48 are illustrated. First the adapter will be placed onto the top liquid dispenser support 2 of the liquid dispenser 1, pressing the feed tube seal 19 onto the feed tube 7. The bottom surface 51 of the adapter 9 will rest on the top surface 52 of the liquid dispenser support 2. A water tight connection is formed from the liquid inlet 26 of the adapter to the liquid outlet 44 of the feed tube connector 14. A bag-in-box container with an outlet comprising a self-sealing valve or membrane 48 can now be placed onto the adapter 9. By placing the bag-in-box container 10 onto the adapter, the weight of the bag-in-box carton 49 and flexible bag 50 filled with liquid will see to it that the probe 12 of the adapter will pierce through the self-sealing valve 48 or membrane of the outlet 15 allowing liquid to run from the flexible bag 50 through the adapter 12 and through the feed tube 7 into the liquid reservoir 8 of the liquid dispenser 1.

Figure 8A:
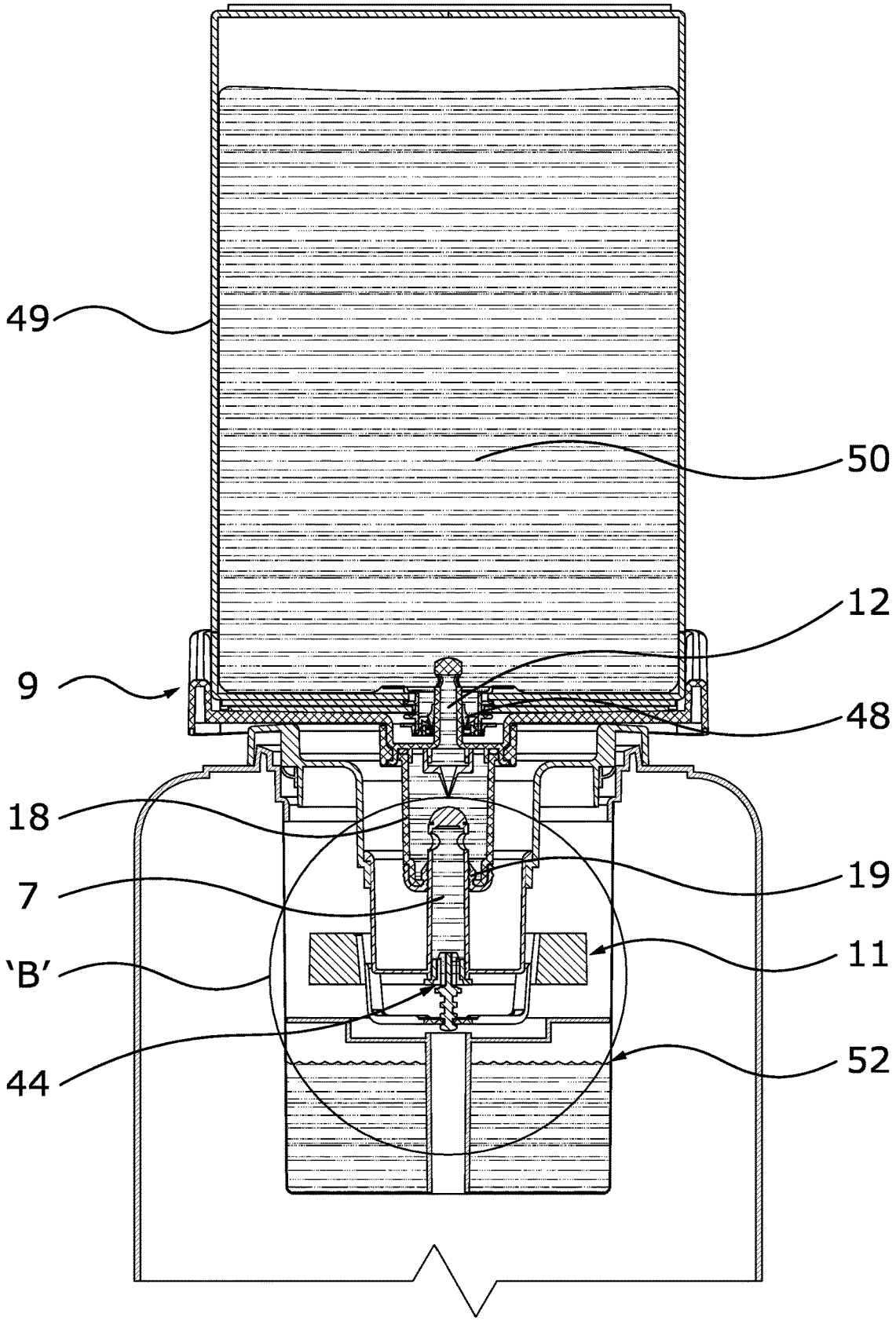
FIG. 8A is a sectioned front view of FIG. 2A showing a schematic section of the inner parts of a liquid dispenser with an open valve outlet to the liquid reservoir.

FIG. 8A schematically shows a sectioned front view of a liquid dispenser fully assembled with an adapter 9 according to the invention and a cooperating liquid transfer regulating means 11, including a schematically illustrated bag-in-box container with the flexible bag 50 filled with liquid. This view shows a snapshot of the situation that the liquid in the flexible bag 50 is running through the adapter's probe 12 into the liquid tight area of the dispenser connector 18 and from there through the feed tube 7 of the liquid dispenser 1 out through the open valve area 44 into the liquid reservoir 8. The liquid level 52 in the liquid reservoir 8 in this situation is under the liquid transfer regulating means 11.

Figure 8B:
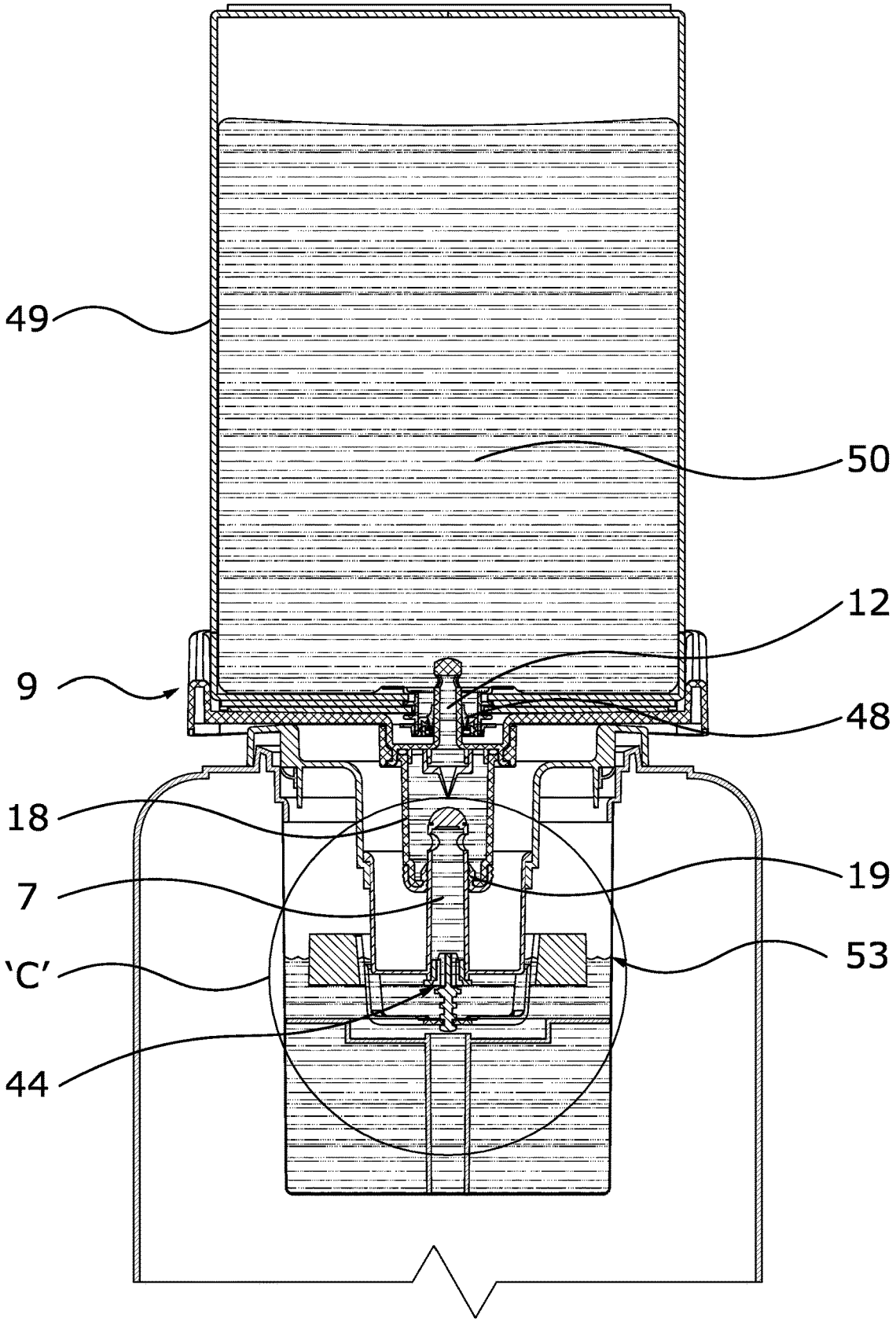
FIG. 8B shows the same as in FIG. 8A, but with a closed valve outlet.

FIG. 8B shows the same parts as FIG. 8A but now the liquid level 53 has risen above the liquid transfer regulating means 11 closing the valve area 44 and prohibiting liquid to flow into the liquid reservoir 8.

Figure 8C:
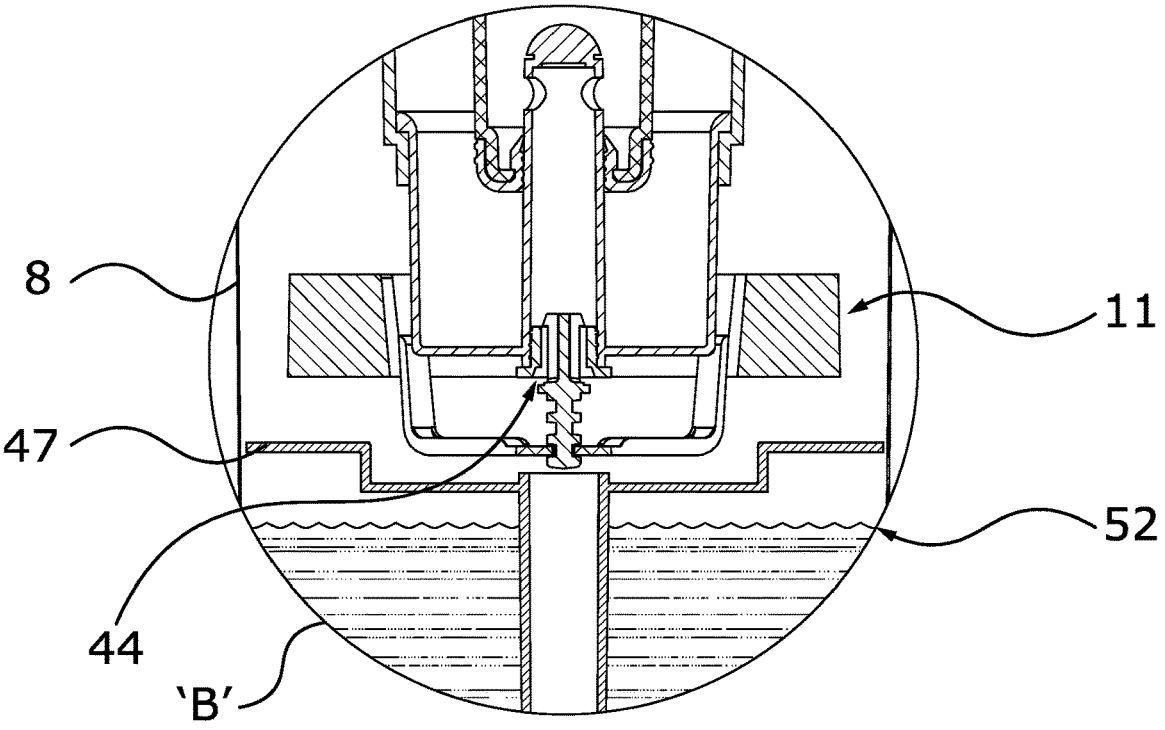
FIG. 8C is an enlarged detail view of portion 'B' shown in FIG. 8A.

FIG. 8C is a more detailed view of the area 'B' of FIG. 8A showing the position of the liquid transfer regulating means 11 in the liquid reservoir 8. More specifically it is shown that the liquid level 52 in the liquid reservoir 8 has not reached the liquid transfer regulating means 11 and thus liquid will continue to flow into the liquid reservoir 8 until the liquid raises to level 53 as shown in FIG. 8B and in more detail in FIG. 8D where the liquid level 53 has reached the liquid transfer regulating means 11 and the buoyancy force of the liquid onto the float 32 has moved the valve shaft 30 up into the feed tube connector 14. The valve surface of the valve shaft 30 is pressed against the valve surface of the feed tube connector 14 closing the valve and thus the liquid outlet area 44.

Figure 8D:
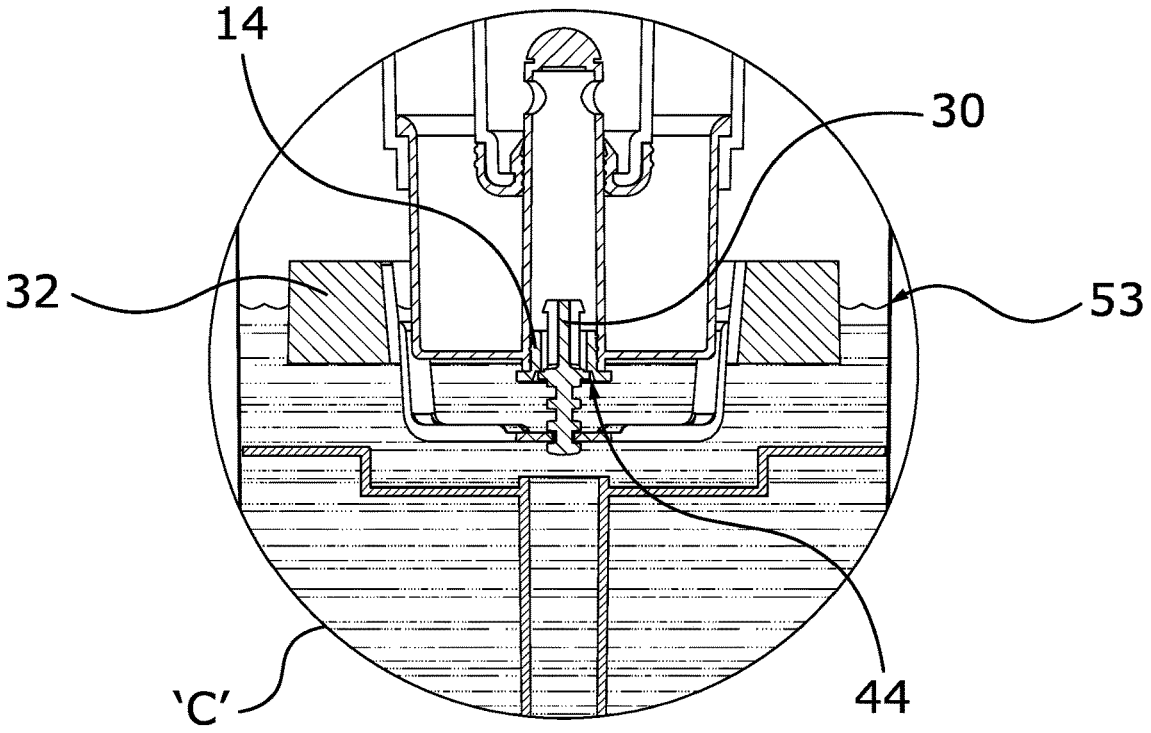
FIG. 8D is an enlarged detail view of portion 'C' shown in FIG. 8B.

Note that to simplify the drawings liquid has not been illustrated in all parts in FIGS. 8C and 8D.

Figure 9A:
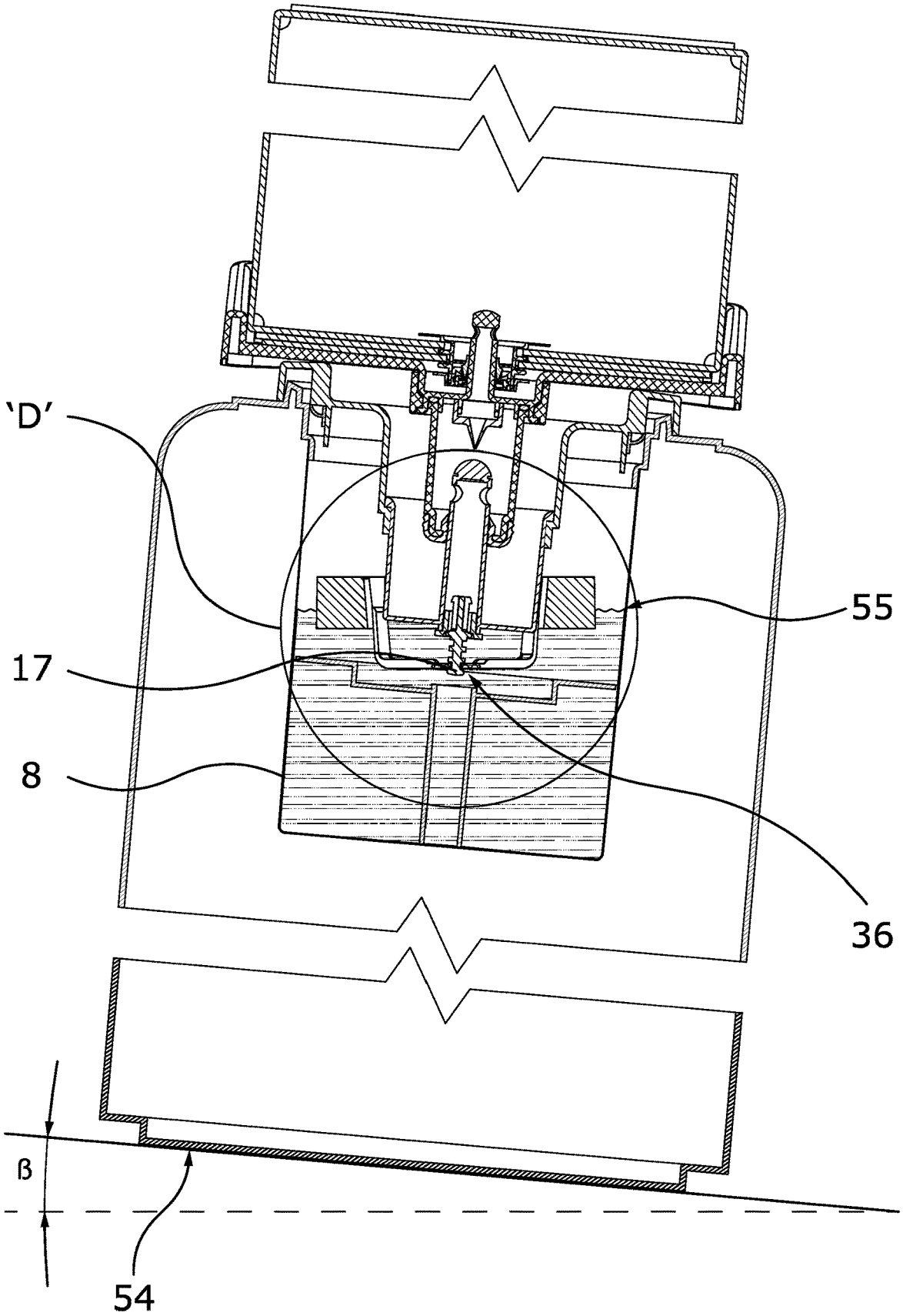
FIG. 9A is a sectioned front view similar to that of FIG. 8B, but showing the liquid dispenser placed on a non-horizontal angled surface.

FIG. 9A shows the same configuration as FIG. 8B, but in this case the liquid dispenser is standing on an uneven surface 54 causing the liquid dispenser to have an angle β in relation to the (level) horizontal plane. This is a very common situation, as most often when installing and placing a liquid dispenser in position one will not check if the liquid dispenser is placed level with the horizontal surface. As the liquid dispenser is angled the liquid reservoir 8 in the liquid dispenser will be non-horizontal. The liquid in the liquid reservoir on the other hand will be horizontal.

Figure 9B:
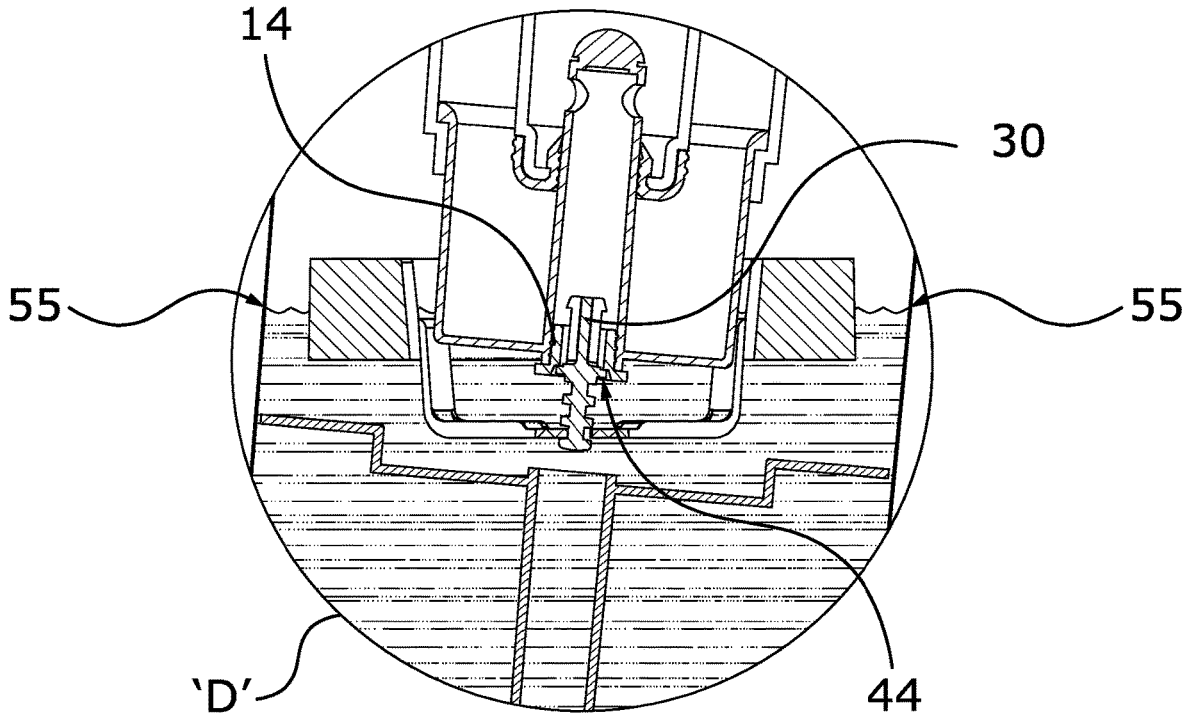
FIG. 9B is an enlarged detail view of portion 'D' shown in FIG. 9A.

FIG. 9B is a more detailed view of the area 'D' of FIG. 9A showing that as the liquid dispenser 1 is angled the liquid reservoir 8, the liquid dispenser support 2 and thus also the feed tube 7 will have the same angle β in relation to the vertical axis (perpendicular to the horizontal plane). The liquid level in the liquid reservoir 8 will always be horizontal. As the float connector 31 can rotate around an angle β around a connection point 35, 36, 37 of the valve shaft 30, the float 32 will remain level with the liquid level 55. In this way there will be a very small amount of non-axial force on the valve shaft 30 which ensures that there is no leakage at the liquid outlet area 44. If the float connector 31 would have a fixed (stiff) connection to the valve shaft 30 and the float 32 would then want to be level with the liquid level 55 this would create a non-axial force on the valve shaft 30 which could cause leakage at the liquid outlet area 44.

Figure 9C:
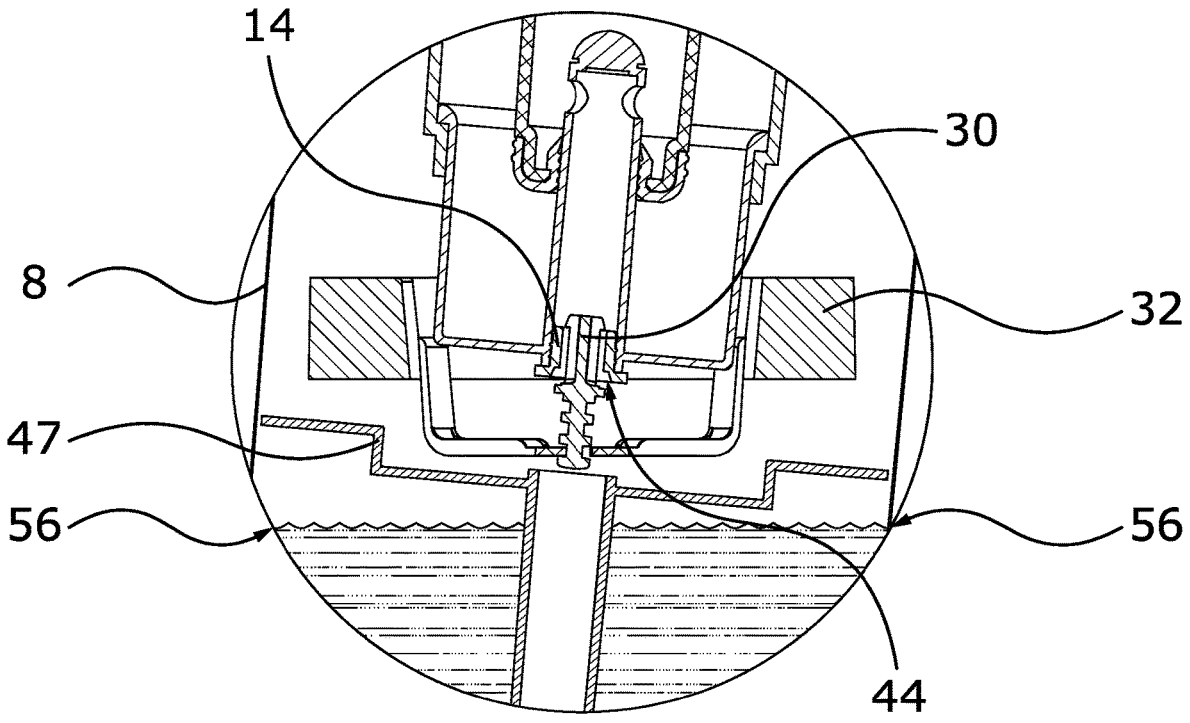
FIG. 9C shows the same detail as in FIG. 9B, but with an open valve outlet to the liquid reservoir.

FIG. 9C shows the same details as in FIG. 9B but in this illustration the liquid level 56 is below the bottom surface of the float 32. The liquid transfer regulating means 11 is now above the liquid level 56 and the liquid outlet area 44 is now open so that liquid can flow into the liquid reservoir 8.

FIG. 10 shows a sectioned front view of the area where the liquid dispenser 1 is connected to the adapter 9 and the adapter is connected to a bag-in-box carton 49, a flexible bag 50 and an outlet 15. The probe 12 of the adapter is inserted into the opening of the outlet 15 so that flowable material can be withdrawn from the flexible bag. The outlet 15 has a self-sealing membrane 48 which is made of an elastomeric material or a material with similar characteristics, one such membrane is available from LMS of Illinois. The connection area 58 between the probe 12 and the self-sealing membrane 48 is an air- and liquid-tight connection allowing the content of the flexible bag 50 only to leave the bag through probe inlet 26. The friction between the probe 12 and the self-sealing membrane 48 ensures a sturdy connection between the bag-in-box container 10 and the adapter 9. FIG. 10 also shows the feed tube seal 19 which is designed to create an air- and liquid-tight connection between the adapter 9 and the feed tube 7 of a water dispenser 1. The feed tube seal 19 is made of an elastomeric material or a material with similar characteristics. When the adapter 9 is connected to a feed tube 7 the feed tube seal 19 will expand around the feed tube 7 creating an air- and liquid-tight connection between the two parts. Due to the tight connection there will be a certain friction between the surfaces where the two parts connect 59. This friction will be large enough that the connection of the parts can be considered as a fixed connection, but not too large, so that the parts can be disassembled with normal human force. The friction between the feed tube seal 19 and the feed tube 7 must be higher than the friction between the self-sealing membrane 48 and the probe 12 of the adapter so that when removing the bag-in-box container 10 the adapter 9 will stay connected to the feed tube 7 of the liquid dispenser 1. The length of the dispenser connector 18 is such that the inlets 40 of the feed tube are inside the dispenser connector 18 and have passed the connecting surface area 59 of the feed tube 7 and feed tube seal 19.

Figure 11A:
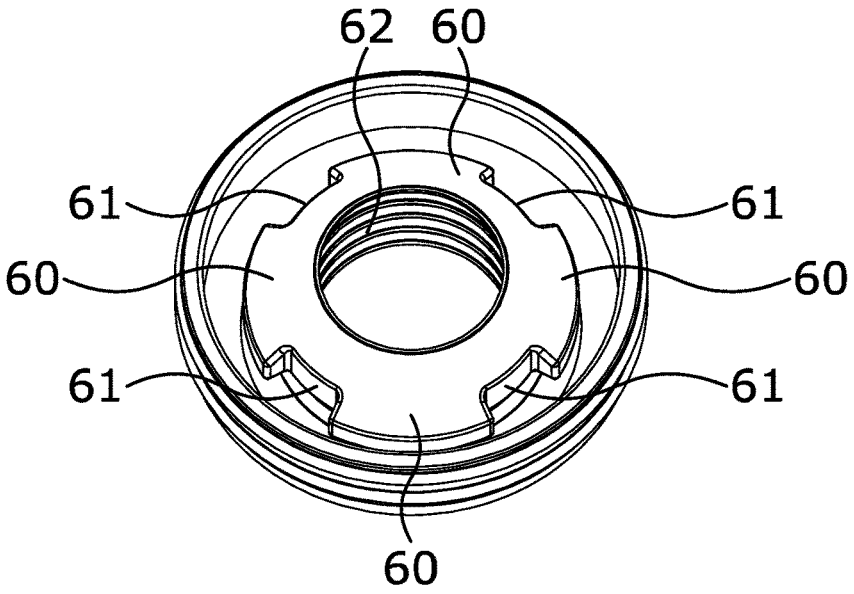
FIG. 11A is a perspective top showing the inner details of the feed tube seal.
Figure 11B:
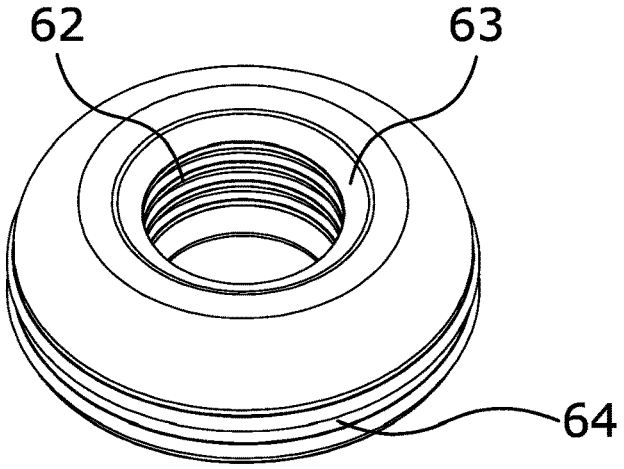
FIG. 11B is a perspective top showing the outer details of the feed tube seal.
Figure 11C:
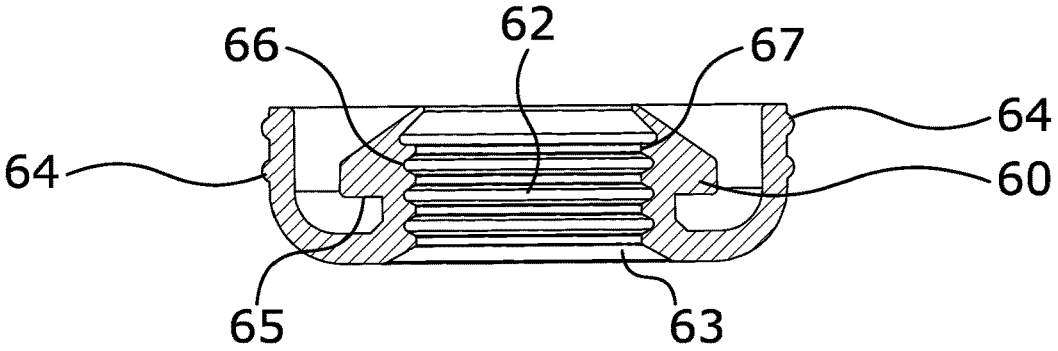
FIG. 11C is a sectioned view of the feed tube seal.

FIG. 11 show the feed tube seal 19 in more detail. In FIG. 11A the inner details of the feed tube seal 19 are illustrated, overhanging parts 60 can be pushed into the outlet of the dispenser connector 18 as the flexible material of the feed tube seal 19 can be compressed into the hole due to the cut-out areas 61 besides the overhanging parts 60. The profiled contact area 62 will be in direct contact with the feed tube 7, the profile has alternating inner surface areas which have a smaller diameter 67 and parts which have a larger diameter 66, as shown in FIG. 11C. This creates the possibility for the feed tube seal 19 to expand around the feed tube 7 and create an air and liquid-tight connection between the two parts. In FIGS. 11B and 11C it is illustrated that the outer surface has a couple of ribs 64, these strengthen the connection of the feed tube seal 19 to the feed tube 7. The inlet surface of the feed tube seal 19 has a chamfered angle 63 which will help guide the feed tube 7 into the adapter 9. The invention is not restricted to the illustrated features of the feed tube seal, other features creating the same or similar functionality as the described configuration are not excluded from the invention.

Figure 12A:
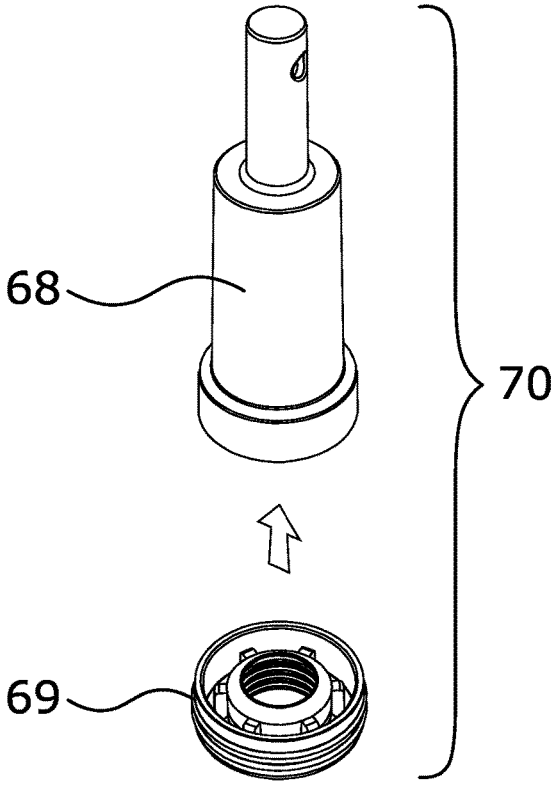
FIG. 12A is an exploded perspective top view of the parts of a basic version of the removable liquid container adapter.

FIG. 12A shows the parts of a basic adapter 70 which has the same functionality as the previously described adapter 9 to transfer liquid from a bag-in-box container 10 to a liquid dispenser 1 but without the part for supporting a bag-in-box container 10. This basic adapter 70 has a basic liquid transfer part 68 and a basic feed tube seal 69.

Figure 12B:
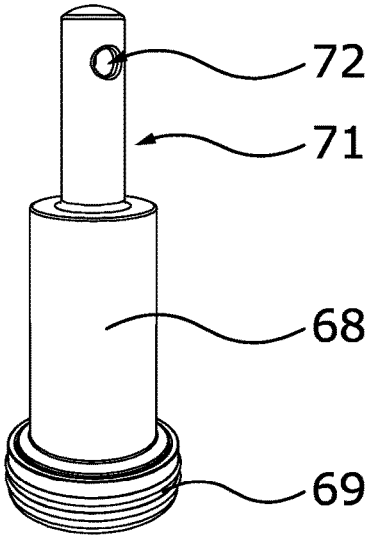
FIG. 12B is a perspective top view of the parts shown in FIG. 12A.

FIG. 12B shows an assembled basic adapter 70, the top part of the basic adapter 70 has a probe shaped part 71 which can be connected to a bag-in-box container 10. Liquid can enter the basic adapter 70 through basic liquid inlets 72 situated on the sides of the probe 71 close to its top.

Figure 12C:
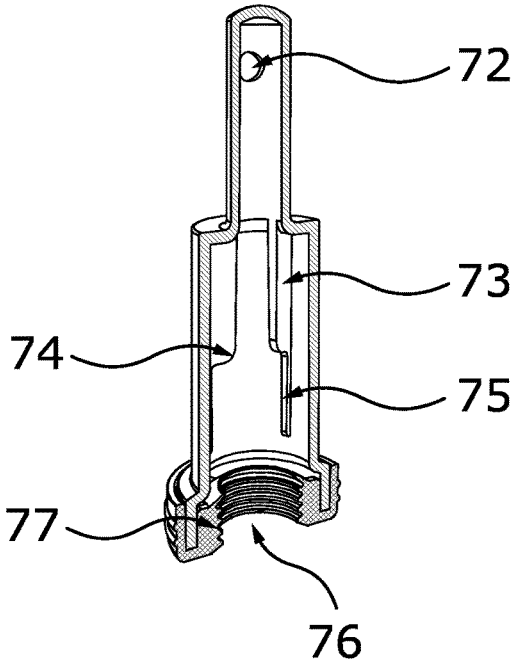
FIG. 12C is a sectioned perspective top view of FIG. 12B.

The sectioned view of the basic adapter 70 in FIG. 12C shows two different types of internal ribs. The upper ribs 73 and in particular the bottom part 74 of the ribs serve as a stop surface. The feed tube 7 will be able to enter through the basic probe outlet 76 and can penetrate through the basic feed tube seal 69 up to the bottom part 74 of the ribs. The lower ribs 75 serve as a support surface for the feed tube 7. The diameter of the internal surfaces of the lower ribs 75 are slightly larger than a standard feed tube 7 and keeps the basic adapter 70 aligned with the feed tube.

Figure 12D:
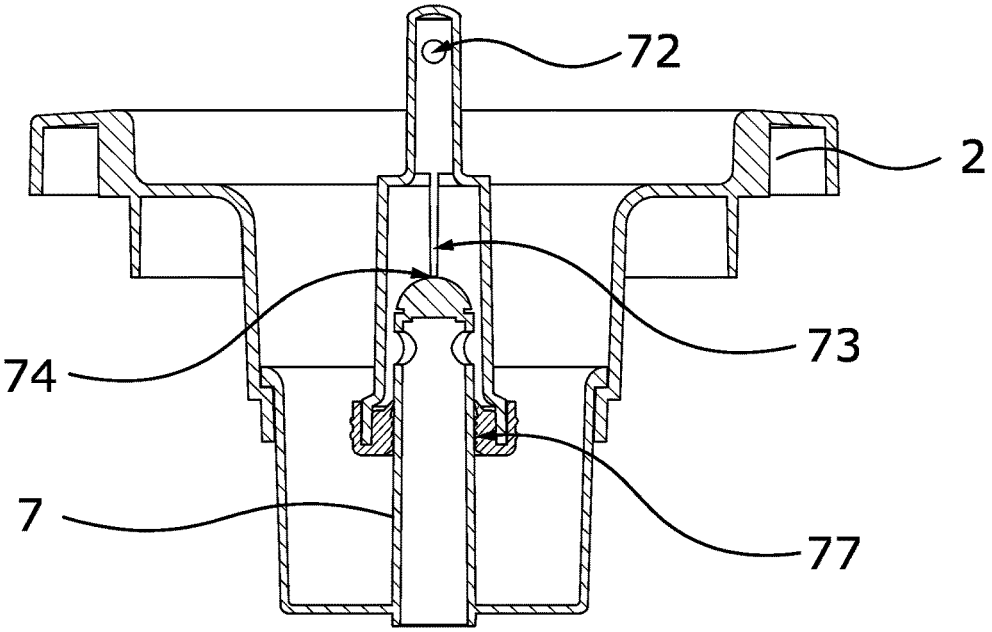
FIG. 12D is a sectioned front view of the simplified adapter mounted on the liquid dispenser support.

In the sectioned cut of the basic adapter 70 assembled on a liquid dispenser support 2 shown in FIG. 12D it is clear how the support surface 74 of the upper ribs 73 connects to the top of the feed tube 7. It is impossible for the feed tube 7 to penetrate the basic adapter 70 further than this point. The characteristics and functionality of the basic feed tube seal 69 is the same as that of the feed tube seal 19 explained in connection with FIG. 10.

Figure 12E:
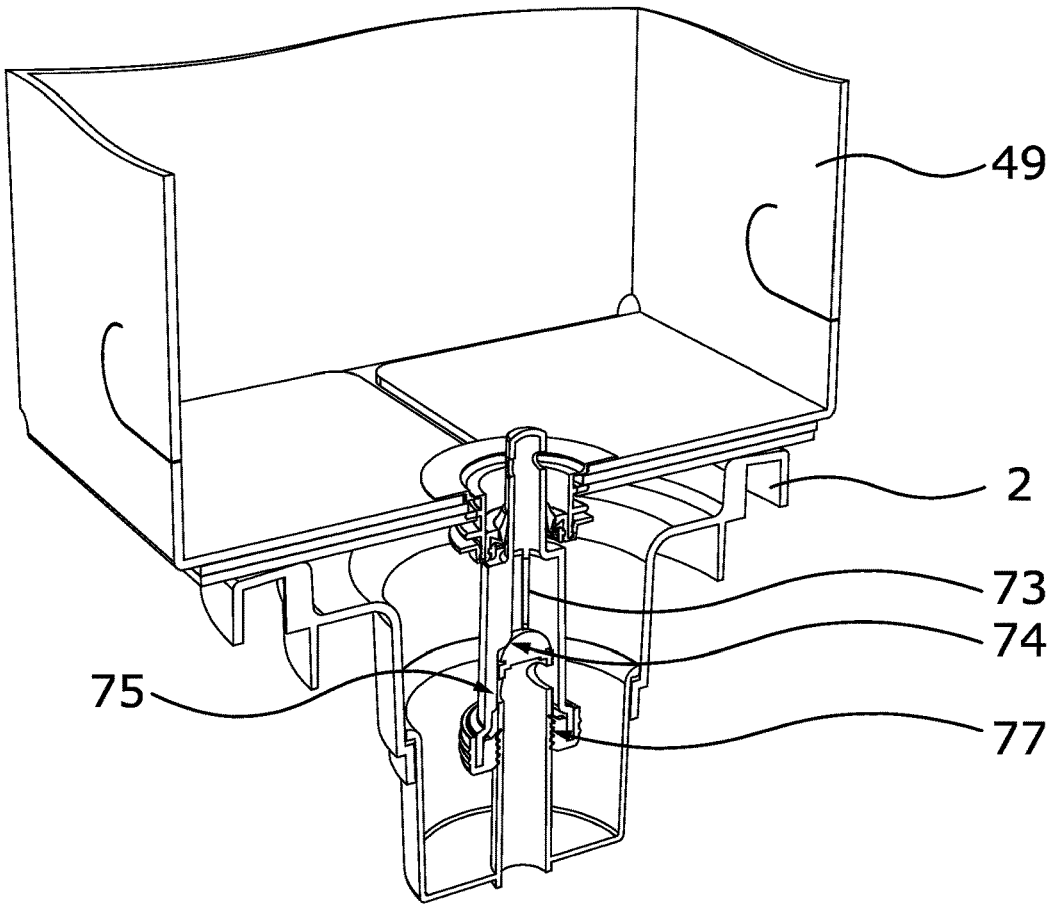
FIG. 12E is a sectioned perspective top view of the simplified adapter mounted on the liquid dispenser support with a removable bag-in-box liquid container mounted on the adapter.

In FIG. 12E it is shown that a bag-in-box container can rest on the top surface of the liquid dispenser support 2 without the necessity of a special support surface or holder for the bag-in-box carton 49. The basic adapter 70 can transfer liquid from a bag-in-box container 10 through the feed tube 7 into the liquid reservoir 8 of a liquid dispenser 1.

Figure 12F:
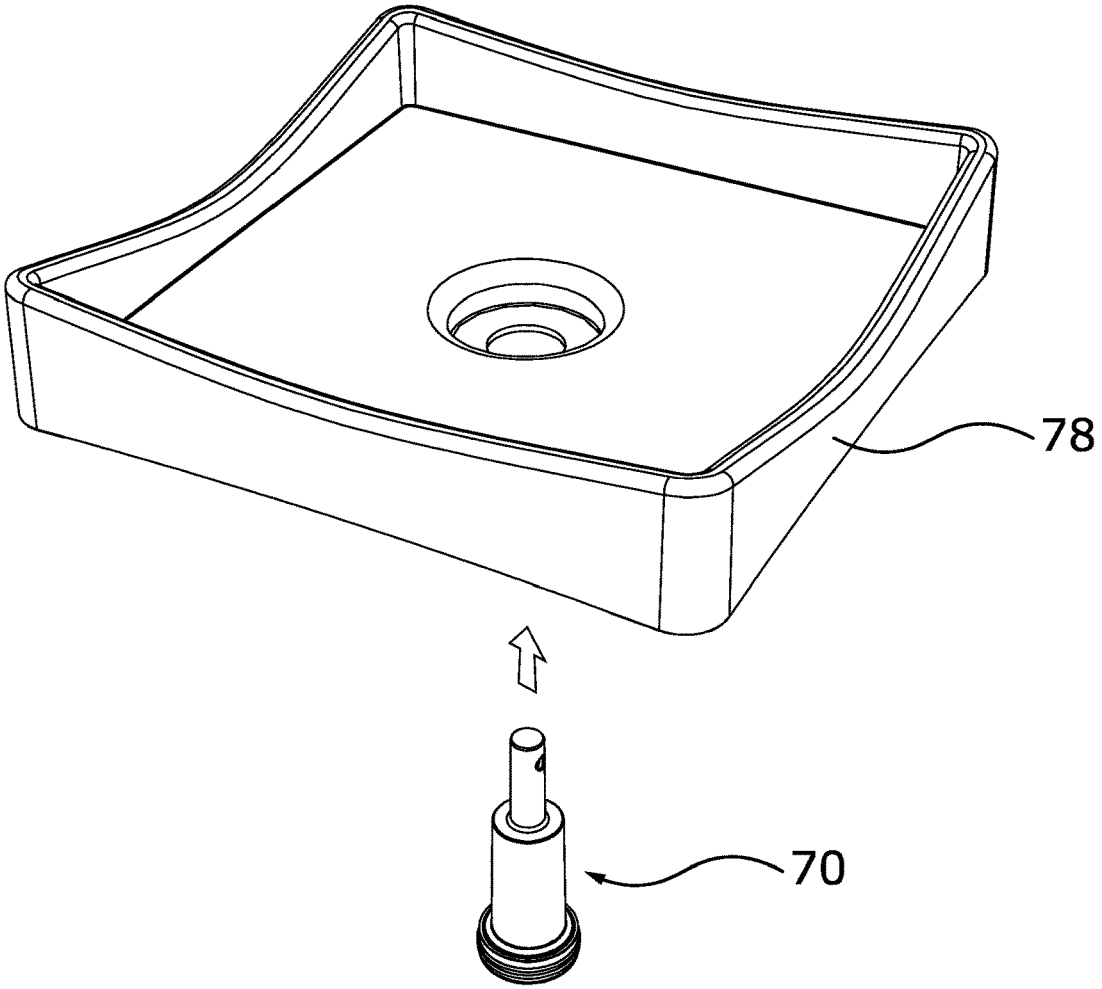
FIG. 12F is an exploded perspective top view of the parts of a basic version of the removable liquid container adapter as in FIG. 12B including a support for a removable liquid container designed as a bag-in-box holder.
Figure 12G:
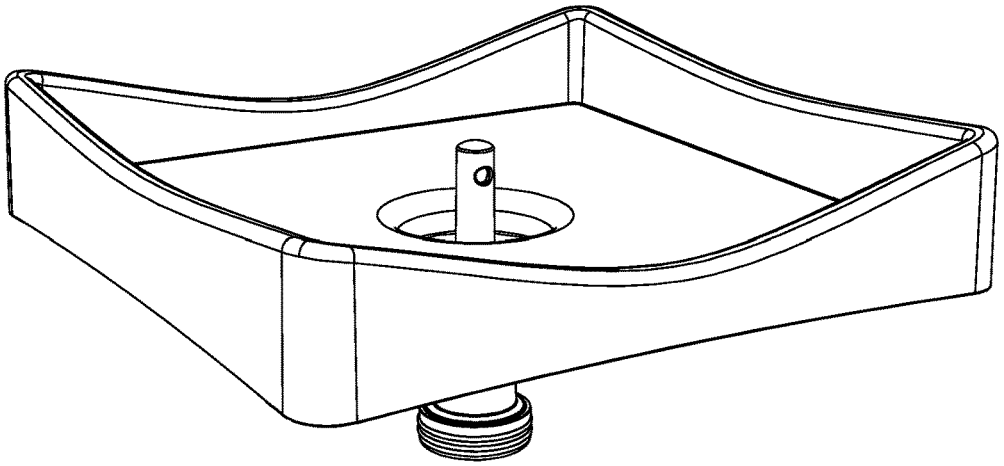
FIG. 12G is a perspective top view of the parts shown in FIG. 12F.

FIGS. 12F and 12G show how the basic adapter 70 can be connected to a basic holder 78 for a bag-in-box container 10 creating a similar construction as the adapter 9 shown in FIG. 4. The basic holder or support 78 can be connected to the basic adapter 70 by means of various known techniques such as press fitting, snapping or screwing the parts together by which the basic adapter 70 and basic support 78 will form a rigid body.

Figure 13A:
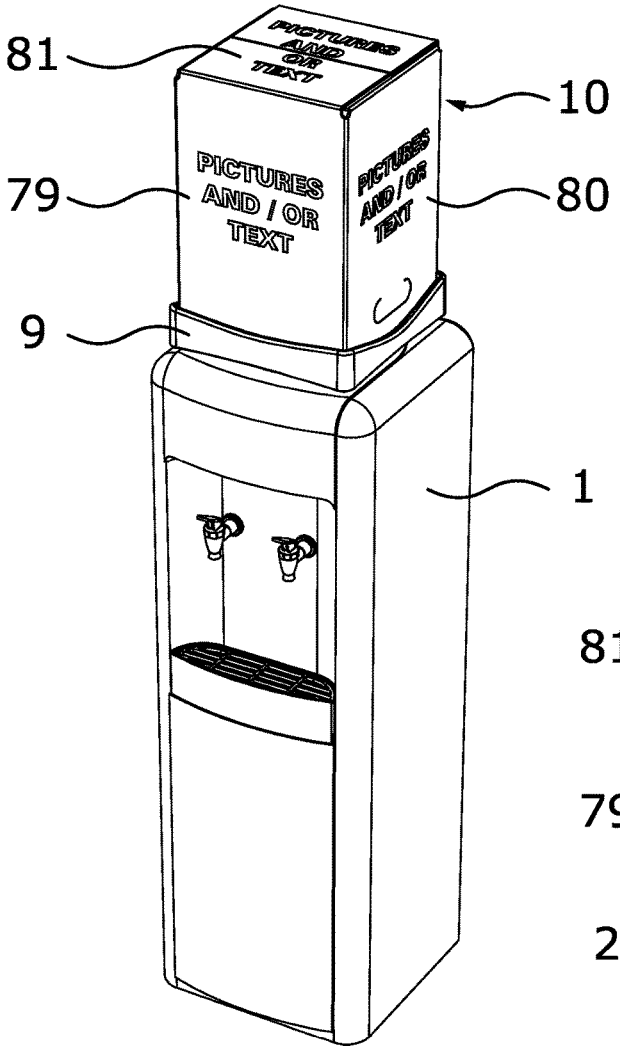
FIG. 13A is a perspective view of a liquid dispenser assembled with the removable liquid container adapter and a bag-in-box carton container.

FIG. 13A shows a liquid dispenser 1 with an adapter 9 fitted with a bag-in-box container 10. More specifically, the figure illustrates how the surfaces of the bag-in-box carton can be used to print on, this could be pictures and/or text. Most liquid dispensers are placed in environments where many different people will use the liquid dispenser. When a person dispenses liquid from the dispenser they will be close to the dispenser (or cooler) for a period of 10 to 30 seconds, or even longer and will be looking at the dispenser. The printed surface of the carton box would most likely to be looked at during the interaction with the dispenser, the printed surface could be a message from a company, for instance an advertisement. The printed messages can be placed on the front of the box 79, on the sides of the box 80, on the top of the box 81 or even on the back of the box. Liquid dispensers are often placed in surroundings where companies do not have an opportunity to advertise, printed messages on the bag-in-box carton could create unique marketing opportunities. For example a water company can give away water in special printed boxes, or sell such water boxes at a lower price, as the water is paid for by the printed message on the box.

Figure 13B:
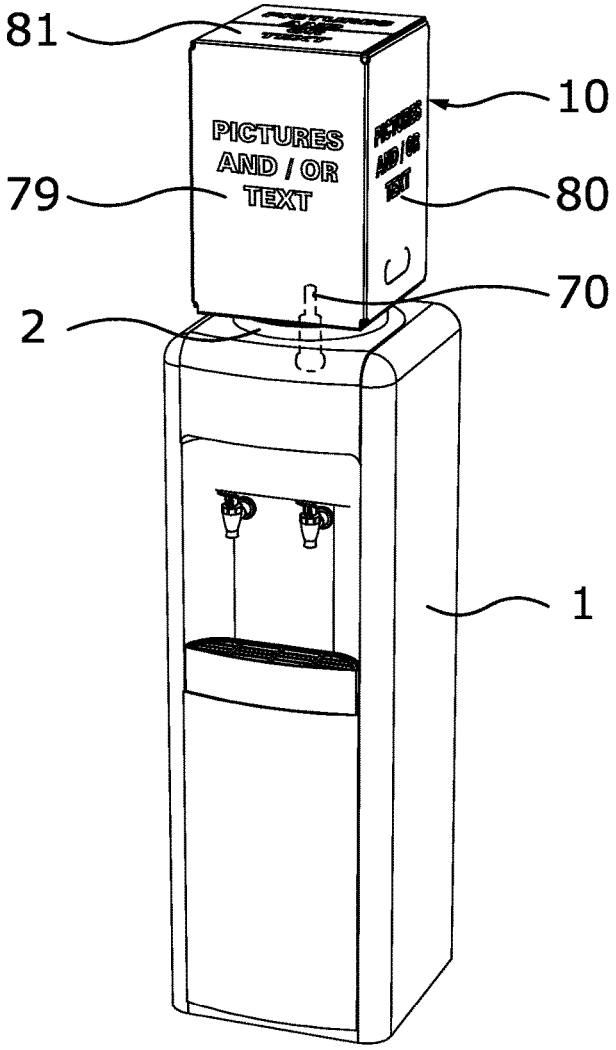
FIG. 13B is a perspective view of a liquid dispenser assembled with the basic version of the removable liquid container adapter and a bag-in-box carton container.

FIG. 13B shows similar assembly as in FIG. 13A but with a basic adapter 70 (indicated with dashed lines) fitted with a bag-in-box container 10. When using a basic adapter 70 the complete sides of bag-in-box container 10 are visible, making it possible to use the whole visible surface of the box for pictures and/or text.

In the foregoing, the present invention has been described with the aid of a number of different embodiments and with reference to the accompanying drawings. It should be understood, however, that the invention is not limited to the described embodiments and to what is shown in drawings, but that also other embodiments are conceivable within the scope of the invention as it is defined by the following claims.

The invention claimed is:

1. An assembly for connecting a removable liquid container (10) to a liquid dispenser (1), wherein said assembly comprises an adapter (9; 70) and a liquid transfer regulating means (11), said adapter (9; 70) having at a first end thereof a liquid container connector (17) and at a second end thereof a dispenser connector (18), said liquid container connector (17) having a probe part (12; 71) adapted to pierce an outlet (15) comprising a self-sealing valve or membrane of said removable liquid container (10), said probe part (12; 71) being hollow and having at least one inlet (26; 72) for liquid from said removable liquid container (10), said dispenser connector (18) being hollow and having at its end remote from said probe part an outlet (25; 76) for liquid from said removable liquid container (10), wherein said outlet (25; 76) of said dispenser connector (18) is adapted to fit tightly around an existing feed tube (7) of said liquid dispenser (1) and wherein an area around said outlet (25; 76) of said dispenser connector (18) is made of an elastomeric material, adapted to create an air- and liquid-tight connection between said adapter (9; 70) and said feed tube (7) of said liquid dispenser (1), characterized in that said elastomeric material, or material with similar characteristics, is adapted to provide a friction between itself and said feed tube (7) that is higher than between said probe part (12; 71) and said self-sealing valve or membrane of said outlet (15) of said removable liquid container (10), and that said adapter (9), when in use, is adapted to cooperate with a said liquid transfer regulating means (11), which is mounted in a top opening (13) of a liquid reservoir (8) of said liquid dispenser (1) and connected to an outlet (44) of said feed tube (7) via a feed tube connector (14) so as to regulate liquid transfer through said adapter (9), wherein said feed tube (7) is integrated into an existing liquid dispenser support (2) of said liquid dispenser (1).

2. The assembly according to claim 1, characterized in that said adapter (9; 70), when in use, is adapted to transfer liquid from said at least one inlet (26; 72) of said probe part (12; 71) to one or several inlets (40) of said feed tube (7) of said liquid dispenser (1) and that said adapter (9; 70) is dimensioned so that, when in use, said at least one inlet (26; 72) of said probe part (12; 71) is positioned higher than said self-sealing valve or membrane of said outlet (15) of said removable liquid container (10) in a vertical direction and so that said outlet (25; 76) of said dispenser connector (18) is positioned lower than said one or several inlets (40) of said feed tube (7) of said liquid dispenser (1) in a vertical direction.

3. The assembly according to claim 1, characterized in that said probe part (12; 71) has a circular shape with a closed top and that said at least one inlet (26; 72) of said probe part (12; 71) is placed below said closed top.

4. The assembly according to claim 1, characterized in that said outlet (25; 76) of said dispenser connector (18) is adapted to fit within an existing recessed area around said feed tube (7) of said liquid dispenser (1).

5. The assembly according to claim 1, characterized in that said outlet (25; 76) of said dispenser connector (18) is adapted to fit within a recessed area formed by an existing liquid dispenser support (2) of said liquid dispenser (1), which is designed for receiving and supporting a liquid bottle (3) in an inverted position.

6. The assembly according to claim 1, characterized in that said elastomeric material, or material with similar characteristics, is provided in the form of an expandable circular feed tube seal (19; 69) having a slightly smaller inner diameter than an outer diameter of said feed tube (7) of said liquid dispenser (1).

7. The assembly according to claim 6, characterized in that said feed tube seal (19; 69) has a profiled inner surface (66, 67) allowing said feed tube seal (19; 69) to expand around said feed tube (7) and create an air and liquid-tight connection between said feed tube seal (19; 69) and said feed tube (7).

8. The assembly according to claim 6, characterized in that said inner diameter of said feed tube seal (19; 69) is between 15.0 and 18.0 mm in a non-expanded state.

9. The assembly according to claim 1, characterized in that said liquid container connector (17) is connected to said dispenser connector (18) with at least one packing ring (20).

10. The assembly according to claim 1, characterized in that said liquid container connector and said dispenser connector form a unitary, substantially rigid hollow body (68).

11. The assembly according to claim 1, characterized in that said liquid container connector (17) is designed as a box connector provided with support surfaces (29) adapted to support and/or hold a removable bag-in-box liquid container (10) in a fixed position on top of said adapter (9) and with a recessed area (28) around said probe part (12) for receiving an outlet (15) with a self-sealing valve or membrane of said removable bag-in-box container (10) whilst the bottom surface of said removable bag-in-box container (10) rests on said support surfaces (29) of said box connector (17).

12. The assembly according to claim 11, characterized in that side surfaces of said box connector (17) are lower at their centre than at their corners to provide easier user access to cut-outs for handles (16) of said removable bag-in-box liquid container (10).

13. The assembly according to claim 1, characterized in that the adapter (9) comprises a duckbill valve (21) or other non-return valve preventing return of liquid into said removable liquid container (10).

14. The assembly according to claim 1, characterized in that said liquid transfer regulating means (11) cooperating with said adapter (9) comprises a valve shaft (30) attached to a float connector (31) and a float (32) connected to said float connector (31), wherein said float (32) has a buoyancy adapted to press a valve surface (42) of said valve shaft (30) against a valve surface (43) of said feed tube connector (14) so as to close said outlet (44) and stop liquid transfer through said adapter (9) and feed tube (7) into said liquid reservoir (8) when a liquid level (53; 55) in said liquid reservoir (8) is high and wherein gravity acting on said liquid transfer regulating means (11) will keep said outlet (44) open so that liquid can flow through said adapter (9) and out of said feed tube (7) into said liquid reservoir (8) when said liquid level (52; 56) is low.

15. The assembly according to claim 14, characterized in that said valve shaft (30) and/or said float (32) has/have different connection points for said float connector (31) enabling different heights of said float (32) relative to said valve shaft (30).

16. The assembly according to claim 15, characterized in that said valve shaft (30) has a reduced diameter at said connection points (35, 36, 37) that is smaller than a diameter of a connection surface of said float connector (31) surrounding said valve shaft so as to allow the float (32) to tilt (β) at least 5 degrees relative to said valve shaft (30), wherein said valve shaft (30) preferably also has bevelled surfaces adjacent to said reduced diameters at said connection points (35, 36, 37) to allow said valve shaft (30) to be made shorter without losing the tilting ability (β) of said float (32).

17. The assembly according to claim 14, characterized in that said float (32) has a maximum dimension of 170 mm and forms a central opening having a diameter greater than 70 mm.

18. A method of installing an assembly according to claim 1, wherein said outlet (25; 76) of said adapter (9; 70) is fitted tightly around said feed tube (7) of said liquid dispenser (1) and wherein said removable liquid container (10) is mounted on top of said liquid dispenser (1) and said hollow probe part (12; 71) of said adapter (9; 70) is caused to pierce said outlet (15) comprising a self-sealing valve or membrane of said removable liquid container (10) to removably connect said removable liquid container (10) to said liquid dispenser (1), characterized in that said liquid dispenser support (2) of said liquid dispenser (1) is removed from said top opening (13) of said liquid reservoir (8) of said liquid dispenser (1), that said liquid transfer regulating means (11) is connected to said outlet (44) of said feed tube (7) integrated into said liquid dispenser support (2) via said feed tube connector (14), and that said liquid dispenser support (2) with said liquid transfer regulating means (11) connected thereto is reinserted into said top opening (13) before fitting said outlet (25) of said adapter (9) tightly around said feed tube (7).

* * * * *